US011512558B2

(12) United States Patent
Radford et al.

(10) Patent No.: US 11,512,558 B2
(45) Date of Patent: Nov. 29, 2022

(54) DEVICE AND METHOD TO TRIGGER, SHIFT, AND/OR OPERATE A DOWNHOLE DEVICE OF A DRILLING STRING IN A WELLBORE

(71) Applicant: Black Diamond Oilfield Rentals LLC, Houston, TX (US)

(72) Inventors: Steven R Radford, Houston, TX (US); Brian D. Hill, Houston, TX (US); Carl E. Poteet, III, Houston, TX (US); Brian L. Christen, Houston, TX (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 41 days.

(21) Appl. No.: 17/089,616

(22) Filed: Nov. 4, 2020

(65) Prior Publication Data

US 2021/0131224 A1 May 6, 2021

Related U.S. Application Data

(60) Provisional application No. 63/008,364, filed on Apr. 10, 2020, provisional application No. 62/931,629, filed on Nov. 6, 2019.

(51) Int. Cl.

| | |
|---|---|
| ***E21B 34/08*** | (2006.01) |
| ***E21B 47/06*** | (2012.01) |
| ***E21B 10/60*** | (2006.01) |
| ***E21B 34/14*** | (2006.01) |
| ***E21B 3/00*** | (2006.01) |

(52) U.S. Cl.
CPC ..... *E21B 34/08* (2013.01); *E21B 3/00* (2013.01); *E21B 10/60* (2013.01); *E21B 34/14* (2013.01); *E21B 47/06* (2013.01); *E21B 2200/06* (2020.05)

(58) Field of Classification Search
CPC . E21B 34/08; E21B 3/00; E21B 10/60; E21B 34/14; E21B 47/06; E21B 2200/06; E21B 21/103; E21B 21/10
See application file for complete search history.

(56) References Cited

U.S. PATENT DOCUMENTS

| | | | |
|---|---|---|---|
| 6,263,969 B1 | 7/2001 | Stoesz et al. | |
| 6,782,952 B2 | 8/2004 | Garay et al. | |
| 2005/0178560 A1* | 8/2005 | Johansen | E21B 23/04 166/374 |

(Continued)

OTHER PUBLICATIONS

Foreign Search Report on PCT PCT/US2020/059416 dated Feb. 4, 2021, 12 pages.

*Primary Examiner* — Caroline N Butcher
(74) *Attorney, Agent, or Firm* — Foley & Lardner LLP

(57) ABSTRACT

A downhole device and method to trigger, shift, and/or operate a downhole device of a drilling string in a wellbore is disclosed. At a high level, the disclosed device causes a portion of drilling fluids to bypass the drill bit and into the annulus. The bypass may be triggered upon certain conditions related to the rotation speeds of the drill string or other conditions such as the pressure of the drilling fluids. For example, the drill string may be rotated in some protocol of operation (e.g., stop at certain rpm, and/or stop at certain other rpm) to describe a recognizable series of signals to an accelerometer and/or microprocessor that will communicate to pumps or valves to operate or pause/stop operations.

35 Claims, 14 Drawing Sheets

(56) References Cited

U.S. PATENT DOCUMENTS

| | | | | |
|---|---|---|---|---|
| 2008/0277119 | A1* | 11/2008 | Hill, Jr. | E21B 34/10 166/305.1 |
| 2015/0345240 | A1* | 12/2015 | Roders | E21B 21/103 175/48 |
| 2017/0058644 | A1 | 3/2017 | Andreychuk et al. | |
| 2018/0258721 | A1 | 9/2018 | Pawar et al. | |
| 2018/0306000 | A1 | 10/2018 | Deboer | |
| 2019/0106954 | A1* | 4/2019 | Brown-Kerr | E21B 47/18 |

* cited by examiner

DEVICE AND METHOD TO TRIGGER, SHIFT, AND/OR OPERATE A DOWNHOLE DEVICE OF A DRILLING STRING IN A WELLBORE

PRIOR RELATED APPLICATIONS

This application claims the benefit of U.S. Provisional Patent Application Ser. No. 63/008,364 entitled "DEVICE AND METHOD TO TRIGGER, SHIFT, AND/OR OPERATE A DOWNHOLE DEVICE OF A DRILLING STRING IN A WELLBORE," filed on Apr. 10, 2020, and U.S. Provisional Patent Application Ser. No. 62/931,629 entitled "DEVICE AND METHOD TO TRIGGER, SHIFT, AND/OR OPERATE A DOWNHOLE DEVICE OF A DRILLING STRING IN A WELLBORE," filed on Nov. 6, 2019.

FIELD

The present invention relates generally to a device for use in downhole drilling.

BACKGROUND

While performing drilling operations in an oil and gas well, a drill string rotates a drill bit at an end of the drill string and circulates fluids, such as drilling mud, through the drill string and the drill bit. The fluids may lubricate, cool, and clean the drill bit. The fluids may also control downhole pressure, stabilize the wall of the borehole, and remove drill bit cuttings from the bottom of the hole. Very often, the fluids are engineered with different chemical make-ups to suit specific well applications. Sometimes controlling certain physical or operation properties of the fluids, such as the flow rate through the drill bit, may be as important as controlling the chemical make-ups.

Sometimes operations of downhole tools may be controlled using various sensors and controllers in a closed control loop. For example, U.S. Pat. No. 9,879,518 discloses an intelligent reamer for drilling using rotation sensor, fluid operation sensor, and a control scheme based on the measured rotational rate of the drill string (e.g., an rpm protocol).

Conventionally, a specialized downhole tool (i.e., DSI PBL® sub) may be used to bypass fluids from the drill bit. Such specialized downhole tool may achieve the bypass function by dropping a metal or polymer, hard or malleable ball into the drill string from the derrick floor. The ball then travels downhole and eventually seats into the bypass sub, sealing against the passage downhole. After sealing, the drilling fluids are forced toward lateral vent holes, thus bypassing the drill bit. To terminate this bypass, additional small balls are pumped down the drill string. The smaller balls will block the lateral vent holes. As the lateral vent holes are closed, the malleable metal or polymer ball are deformed and pushed through its seat and into a collector below, thus restoring the flow path to the drill bit.

Such downhole tool (i.e., DSI PBL® sub) often takes a long time for the various balls (either to cause the bypass or to restore the flow) to travel through the drill string and be seated on the seal. In some instances, pumping at 600 gpm down a 10,000 ft drill pipe of 5½-inch diameter would take approximately 12-15 minutes. Such downhole tool (i.e., DSI PBL® sub) also has a limited number of bypass/restore cycles before tool replacement. In some instances, because the collector becomes fully filled, only five sets of malleable metal or polymer ball may be inserted to cause bypasses before the whole downhole tool (i.e., DSI PBL® sub) must be replaced before further bypass operations. Furthermore, dropping the balls into the drill string to be pumped down to the bypass sub is typically a manual operation.

SUMMARY

This disclosure presents a downhole device and method to trigger, shift, and/or operate a downhole device of a drilling string in a wellbore. At a high level, the disclosed device causes a portion of drilling fluids to bypass the drill bit and into the annulus. The bypass may be triggered upon certain conditions related to the rotation speeds of the drill string or other conditions such as the pressure of the drilling fluids. For example, the drill string may be rotated in some protocol of operation (e.g., rotate at certain rpm for a certain time period, and/or stop at certain other rpm for a certain time period or stop rotating for a predetermined time period, and so forth) to describe a recognizable series of signals to an accelerometer and/or microprocessor that will communicate to pumps or valves to operate or pause/stop operations. In other instances, the bypass may be triggered in response to changes in the drill string weight, which may be varied in a recognizable fashion such that a load cell may send signals to a microprocessor and open or close valves or pump. The internal drill string pressure variations may be distinctive and recognizable by a pressure transducer in the downhole device. Such variations may then trigger a microprocessor to send further signals to start/stop a pump or open/close a bypass valve or port in the disclosed device.

The disclosed device and method of bypassing drilling fluids from the drill bit may be used in various situations. For example, the use of rotation rate (e.g., revolutions per minute, or rpm) recognition or other methods may be used to start a pump or open/close valves and flow paths for the drilling mud to bypass some or all of the drilling mud from the drill string to the annulus, such as in order to apply fillers to amend cracks that cause fluid loss or leakage. The bypass fluids may also be used to power other devices or provide a source of data for measurements.

The disclosed device employs sensors and controllers to make use of the rpm protocol to produce signals that may also be used to extend/retract certain pistons in the downhole device wall to cut a small amount of wall material. For example, after a certain protocol to wake up the downhole device that whenever certain rpm is recognized, reamer pistons may extend a short amount in response to the recognized condition. Continuing to rotate the downhole device will cause the hole to open a small amount more than the bit is cutting so that ultimately when the bottom hole assembly (BHA) is tripped out of the hole, the bit and other components may pass more easily with less interference.

Such hole opening processes utilizing the monitored rpm and controller signals may be automatic and thus unnoticed by the driller. As a result of the reamer piston's operation, the reamer may smooth out the tight spots caused by the bent motor or other drilling equipment in directional drilling. The rpm or other signal from the driller to the disclosed device may also open an expandable reamer. For example, the disclosed tool may shift a sleeve connected by linkages to reamer blocks, causing the blocks to slide axially up and radially out at a prescribed small angle, thus opening a reamer. Polycrystalline diamond compacts (PDC) and/or other cutting elements of extreme hardness, wear resistance and thermal conductivity will ream and radially enlarge the hole, for example, more or less by 20%.

In a first general aspect, the disclosed downhole device for having bypassing drill fluids bypass a drill bit is disclosed.

The device includes a sleeve, sealingly slidable inside a body, the sleeve having a port alignable with a nozzle of the body. The device further includes means for resiliently biasing the sleeve against the body and an actuator configured to provide a pressure to the sleeve and actuate the sleeve to move relative to the body. The device also includes a controller configured to operate the actuator in response to a change of a monitored operation condition.

In one specific aspect, the resilient member includes a spring providing a biasing force corresponding to a threshold trigger pressure.

In another specific aspect, the sleeve may be configured to direct drill fluids to a downhole drill bit when the port is not aligned with the nozzle of the body and is configured to direct a portion of the drill fluids to the downhole drill bit when the port becomes at least partially aligned with the nozzle of the body such that another portion of the drill fluids bypasses the drill bit.

In yet another specific aspect, the downhole device further includes a lock ring setting a movement limit to the sleeve. The lock ring may also provide a point of support for the resilient member.

In one specific aspect, the body may include an internal tube housing the sleeve and at least one radial compartment housing at least one of an oil accumulator, a motor pump, a battery, the actuator, or the controller.

In another specific aspect, the actuator includes a three-way control valve.

In yet another specific aspect, the actuator may include an accumulator or a pressure compensator.

In one specific aspect, the controller may be configured to operate the actuator in response to an internal drill string pressure variation measured in a pressure transducer, in some embodiments, the internal drill string pressure variation satisfies a trigger condition.

In a second general aspect, a method for bypassing drilling fluids from a downhole drill bit is disclosed. The method includes: providing a drill bit a flow of drilling fluids; determining whether a trigger condition has been satisfied; upon determining the trigger condition has been satisfied, actuating a sleeve to move relative to a body, sealingly housing the sleeve, and at least partially aligning a port in the sleeve to a nozzle of the body; and directing a portion of the flow of drilling fluids through the port and the nozzle to bypass the drill bit.

In one specific aspect, determining the satisfaction of the trigger condition may include measuring a value related to a rotation speed of the downhole drill bit or a pressure of the drilling fluids and comparing the measured value to a reference value.

In another specific aspect, determining the satisfaction of the trigger condition may include receiving a control signal from a controller, in some embodiments, the control signal is provided in response to a rotation protocol. In other instances, the control signal may also be determined based on depth, user input, or other operation feedbacks.

In yet another specific aspect, determining the satisfaction of the trigger condition may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In one specific aspect, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In another specific aspect, the method further includes biasing the sleeve against the body to close the port from the nozzle upon determining the trigger condition has not been satisfied.

In yet another specific aspect, biasing the sleeve against the body to close the port from the nozzle may include offsetting the port from the nozzle using a spring.

In one specific aspect, actuating the sleeve to move relative to the body may include sliding the sleeve inside the body, or rotating the sleeve inside the body, or both.

In a third general aspect, a device for bypassing drill fluids around a drill bit is disclosed. The device comprises a sleeve sealingly slidable inside a body, the sleeve having a port alignable with a nozzle of the body, a resilient member biasing the sleeve against the body, wherein the resilient member comprises a spring providing a biasing force corresponding to a threshold trigger pressure, an actuator configured to provide a pressure to the sleeve and actuate the sleeve to move relative to the body, and a controller configured to operate the actuator in response to a change of a monitored operation condition.

In one specific aspect, the sleeve is configured to direct drill fluids to the drill bit when the port is not aligned with the nozzle of the body and is configured to direct a portion of the drill fluids to the drill bit when the port becomes at least partially aligned with the nozzle of the body such that another portion of the drill fluids bypasses the drill bit.

In another specific aspect, the device further comprises a lock ring setting a movement limit to the sleeve.

In yet another specific aspect, the body comprises an internal tube housing the sleeve and at least one radial compartment housing at least one of an oil accumulator, a motor pump, a battery, the actuator, or the controller.

In one specific aspect, the actuator includes a three-way control valve. In an embodiment, the actuator includes an accumulator, a pressure compensator, or both.

In another specific aspect, the controller is configured to operate the actuator in response to an internal drill string pressure variation measured in a pressure transducer. In an embodiment, the internal drill string pressure variation satisfies a trigger condition.

In yet another specific aspect, the body comprises helical carved structures distributed radially on an external surface of the body. In an embodiment, the helical carved structures are oriented in an axial direction of the body and are configured to facilitate flow of the drill fluids bypassed the drill bit.

In a fourth general aspect, a method for controlling drilling fluids in a drill string to bypass a drill bit is disclosed. The method comprises providing the drill bit a flow of drilling fluids in the drill string, determining whether a trigger condition has been satisfied, upon determining the trigger condition has been satisfied, actuating a sleeve to move relative to a body sealingly housing the sleeve, and at least partially aligning a port in the sleeve to a nozzle of the body, and directing a portion of the flow of drilling fluids through the port and the nozzle to bypass the drill bit.

In one specific aspect, the flow of drilling fluids returns in an annulus

In another specific aspect, a resilient member comprises a spring providing a biasing force corresponding to a threshold trigger pressure.

In yet another specific aspect, the determining satisfaction of the trigger condition comprises measuring a value related to a rotation speed of the downhole drill bit or a pressure of the drilling fluids and comparing the measured value to a reference value. In an embodiment, the determining satisfaction of the trigger condition comprises comparing a pressure of the drilling fluids inside the drill string and a pressure of the drilling fluids in the annulus outside the drill string to ascertain a pressure difference.

In one specific aspect, the actuating the sleeve to move relative to the body comprises actuating a three-way valve in response to the pressure difference between the drilling fluids inside the drill string and the drilling fluids in the annulus.

In another specific aspect, the determining the satisfaction of the trigger condition comprises receiving a control signal from a controller, wherein the control signal is provided in response to a rotation protocol.

In yet another specific aspect, the comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

In one specific aspect, the method further comprises biasing the sleeve against the body to close the port from the nozzle upon determining the trigger condition has not been satisfied. In an embodiment, the biasing the sleeve against the body to close the port from the nozzle comprises offsetting the port from the nozzle using a coil spring.

In another specific aspect, the actuating the sleeve to move relative to the body comprises sliding the sleeve inside the body or rotating the sleeve inside the body or both.

In yet another specific aspect, the method further comprises regulating the portion of the flow of drilling fluids bypassed the drill bit using helical carved structures to facilitate fluid flow in the annulus.

In one specific aspect, the directing a portion of the flow of drilling fluids through the port and the nozzle to bypass the drill bit comprises actuating a sleeve to move relative to a body to align an opening in the sleeve to an outlet of the body.

In another specific aspect, the actuating the sleeve includes providing a high pressure oil flow, using a motor driven pump, to move the sleeve.

In a fifth general aspect, a method of making a device for bypassing fluids around a drill bit is disclosed. The method comprises providing a lower sleeve, an upper sleeve and a resilient member, assembling the lower sleeve, the upper sleeve and the resilient member to form a sleeve, assembling a body and the sleeve to form the device for bypassing drill fluids around the drill bit.

In one specific aspect, the sleeve is sealingly slidable inside the body.

In another specific aspect, the sleeve has a port alignable with a nozzle of the body.

In yet another specific aspect, the resilient member comprises a spring providing a biasing force corresponding to a threshold trigger pressure.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein:

FIG. 11C-1 shows a side view of a stop block of the exemplary embodiment of the downhole device shown in FIGS. 11A-11B prior to a second step of assembly;

FIG. 11C-2 shows a side view of the assembled sleeve of the exemplary embodiment of the downhole device shown in FIG. 11B prior to a second step of assembly;

Like numerals refer to like elements.

DETAILED DESCRIPTION

Figure 1:
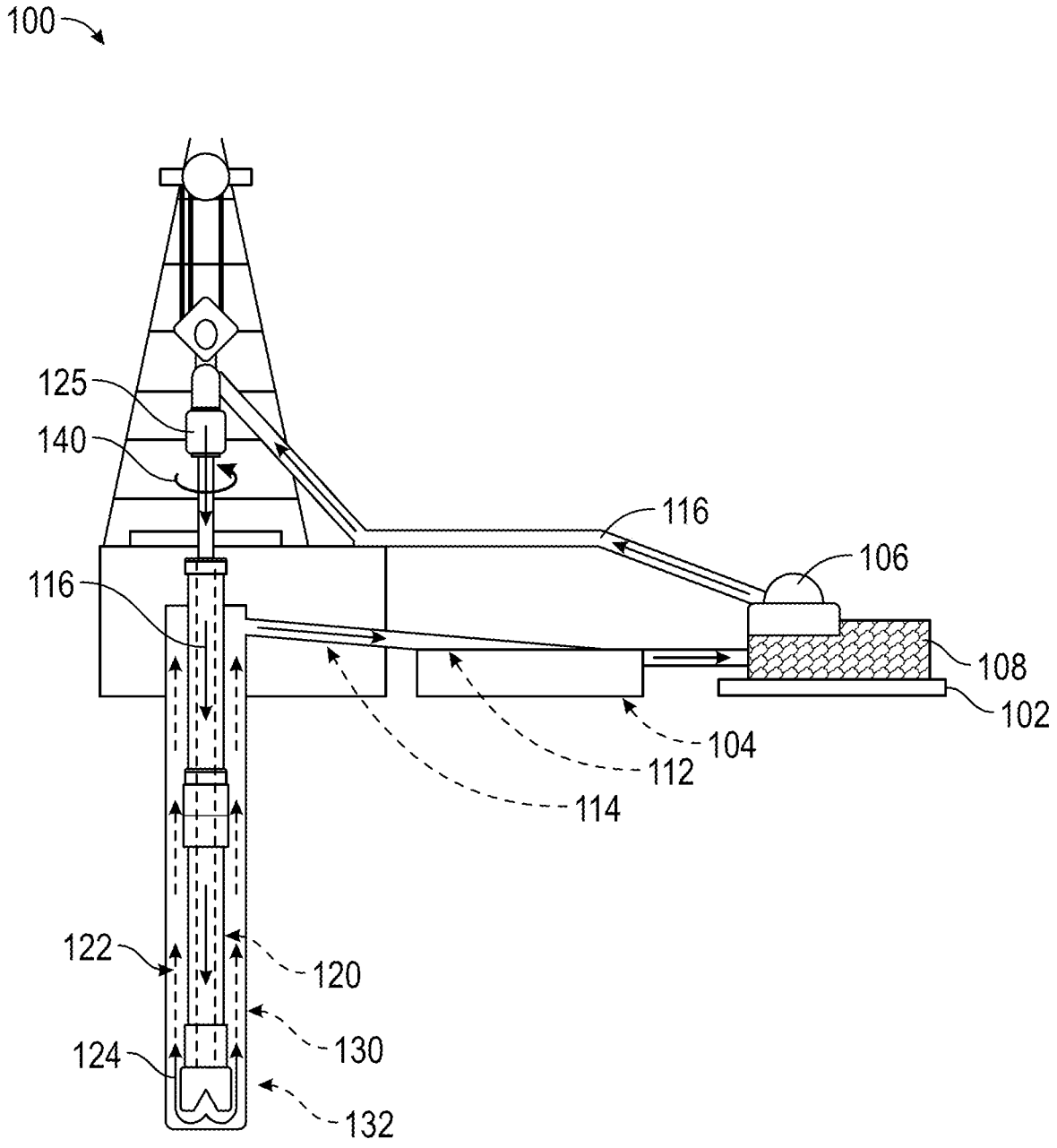
FIG. 1 illustrates an exemplary drilling environment for implementing a downhole device.

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

In general, the disclosed downhole device may run on a drill string during a drilling operation for an oil and gas well. The downhole device may operate to bypass some of the drilling fluid (mud) on command to reduce the flow through the drill bit. The downhole device may respond to a downlink, or communication from the driller on surface, such as signal generated in response to a protocol of rpm changes to a drilling string. In some embodiments, the downhole device may be deployed in the hole in an asleep mode that awaits actuation signals. Once in position, an operator may produce an rpm, pressure, weight, or other predetermined protocol to wake up the tool. Once awaken, the downhole device may respond to rotation rates above a predetermined value for initiating the bypass operation and respond to rotation rates not above the predetermined value for stopping the bypass operation. Other controls based on different measurable values may be used.

The downhole device response to the signal may include the opening or closing of one or more valves and changing of the flow path of hydraulic oil in a mechanism. Alternatively, this action may begin operation of a pump/motor and pump oil to shift a sleeve. This action changes the flow path of drilling mud through the downhole device to accomplish a function, such as sliding a sleeve or opening or closing a flow path for the drilling mud.

Further rpm protocol, or other downlink, pressure, or bit weight protocol may shift the flow path and open and close valves. Other tools incorporating this triggering method may move an internal sleeve to expose drilling reamer elements to expand and increase the inner diameter of the borehole. Another tool may use the resultant sliding sleeve action to force a reaming cutter block up a ramp to increase the inner diameter of the hole. Finally, another modification may be to fully close the borehole and force all of the mudflow to exit the downhole device allowing none to go to the drilling bit.

The disclosed downhole device may begin operation in response to a protocol of rpm changes or changes in bit weight or pressure or flow rate or other. These signals would be recognized by the disclosed downhole device to make the change of flow path or other activity in the downhole device. The disclosed downhole device may open a flow path from the internal tool flow path of drilling mud to the annulus of the downhole device. Some percentage of the mud flowing through the drill string may then bypass to the annulus. In other embodiments, the disclosed downhole device may also open flow path of the drilling mud to borehole reaming pistons or sliding cutter blocks, which may enlarge the borehole.

Drilling Environment Implementing the Downhole Device

FIG. 1 illustrates an exemplary drilling environment 100 for implementing the disclosed downhole device. As shown, the exemplary drilling environment 100 includes a drilling rig having a drilling fluid (e.g., drilling mud) circulation system summarized below. The drilling environment 100 provides a conceptual understanding for the placement of the disclosed downhole device to be discussed and may include other components not shown in FIG. 1. The drilling environment 100 includes a mud reservoir 108 on the ground 102. The mud reservoir 108 receives return drilling mud caught in the mud pit 104 and supplies the mud pump 106 drilling mud to send to the mud feed line 116. The mud feed line 116 feeds drilling mud into the drill string 120 through the swivel or top drive 125. The drilling mud travels along the drill string 120 from the Kelly drive 140 down to and exits the drill bit 132. The drilling mud carries away heat and debris from the drill bit 132 and returns it to the ground 102 via the annulus 122. The annulus 122 is the clearance space created between the outer diameter of the drill string 120 and the side surface 130 of the drilled hole created by the drill bit 132. The returning mud 124 flows from the drill bit 132 in the annulus 122 upward. After returning to the ground 102, the returning mud 124 travels in the mud return line 114 to return to the mud pits 104, passing by the shale shaker 112 to remove the drill debris.

Figure 2:
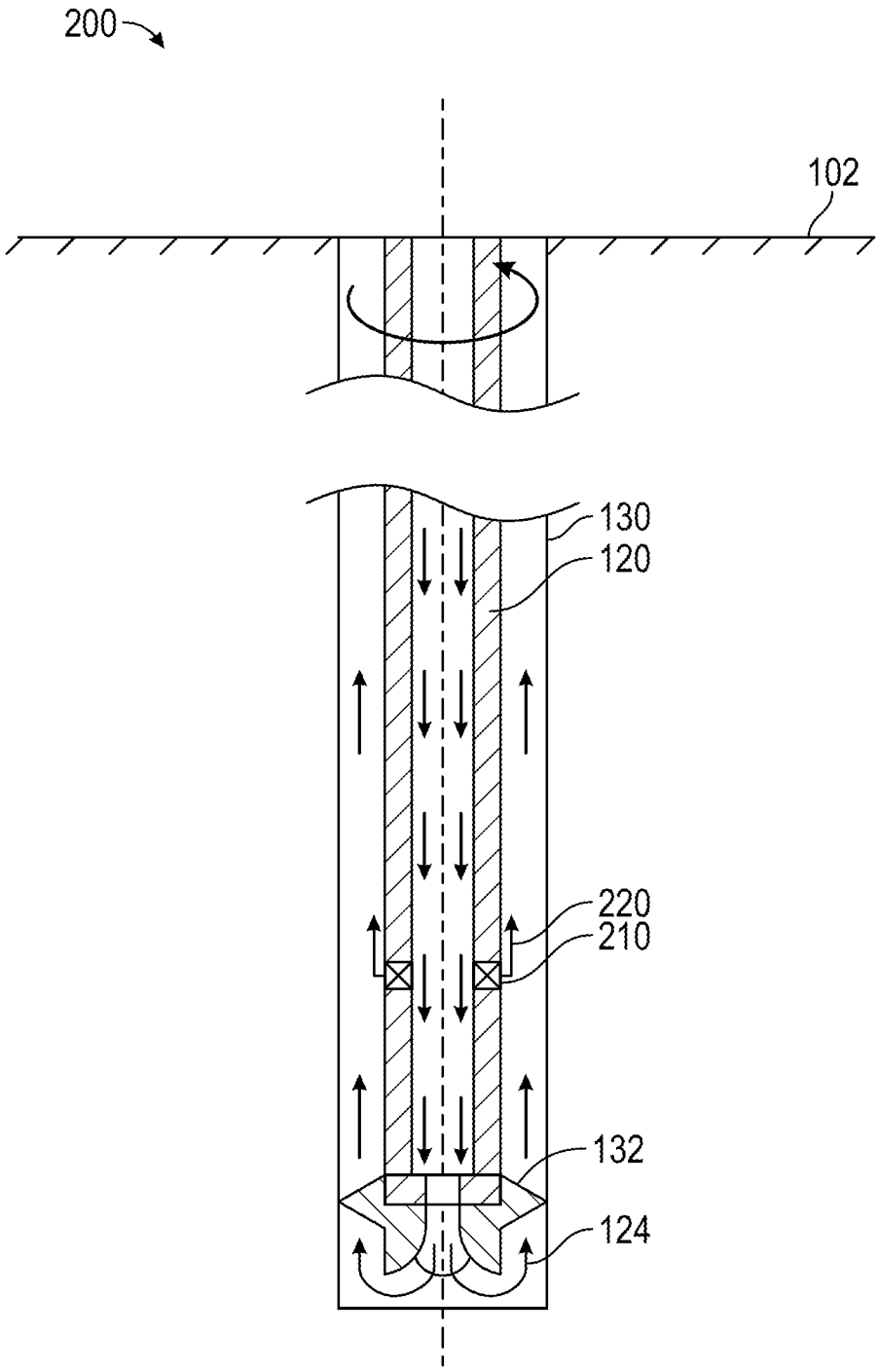
FIG. 2 shows a cross-sectional side view of a conceptual operation of the downhole device in the exemplary drilling environment of FIG. 1.

FIG. 2 shows a local cross-sectional side view of a conceptual operation of the downhole device 210 in the exemplary drilling environment 100 of FIG. 1. The downhole device 210 may be positioned at a desired location between the drill bit 132 and the ground 102. Other components or downhole devices may be installed or positioned between the downhole device 210 and the drill bit 132. When the downhole device 210 is actuated, a portion 220 of the drilling mud may bypass the drill bit 132 and flows into the annulus 120 while the returning mud 124 may include the remaining portion of the drilling mud. Details of the structure of the downhole device 210 in different embodiments are illustrated in FIGS. 3-6 and discussed below.

Exemplary Downhole Devices

Figure 3:
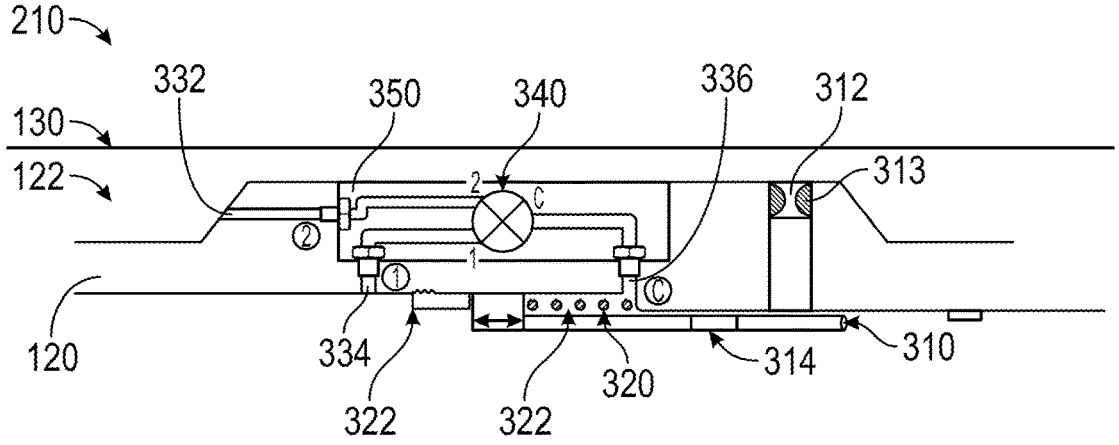
FIG. 3 shows a cross-sectional side view of a first exemplary embodiment of the downhole device.

FIG. 3 shows a cross-sectional side view of a first exemplary embodiment of the downhole device 210. As shown, the downhole device 210 includes a body as part of the drill string 120, a sleeve 310 sealingly slidable inside the body 120. The sleeve 310 may include at least one port 314 alignable with a corresponding bypass outlet 312 of the body 120. The bypass outlet 312 may include an erosion resistant nozzle 313. The downhole device 210 further includes a resilient member 320 (e.g., a spring) biasing the sleeve 310 against the body 120. The downhole device 210 further includes a three-way valve with an actuator 340 that is configured to provide a pressure to the sleeve 310. The actuator 340 can actuate the sleeve 310 to move relative to the body 120, such as to align the bypass outlet 312 with the port 314. The downhole device 210 also includes a controller (e.g., the controller electronics 620 shown in FIG. 6, or implemented as the computer device 700 of FIG. 7 as discussed below) configured to operate the actuator 340 in response to a change of a monitored operation condition.

In some embodiments, the downhole device 210 would use information, measurements, and other received signals (electric or mechanical, such as pressure signals) to actuate the actuator 340. For example, the downhole device 210 may sense or measure the rotation rate in revolutions per minute ("rpm"), weight or pressure signals (e.g., related to well depth, length of drill string 120, and installed components) and control the actuator 340 in response to the measured signals.

Turning to FIG. 3, the downhole device 210 may have a neutral position where the sleeve 310 is biased away from the bypass outlet 312. As a result, the sleeve 310 forms a volume 322 with the body 120. Before actuation, the drill string inlet 334 communicates fluid or its pressure (or both) to the volume inlet 336. Since the drill string inlet 334 takes drilling mud from the bore of the drill string 120 and is fluidly connected to the volume inlet 336 via the three-way valve actuator 340, the sliding sleeve volume 322 would have the same fluid pressure as that of the drill string 120. This pressure of the sliding sleeve volume 322 would be equal to the pressure outside of the sleeve 310 and therefore the sleeve 310 is subject only to the spring 320 and in the neutral position.

In the illustrated embodiment, a lock ring 330 may further be used to define the neutral position, for example, to allow the spring 320 to statically push the sleeve 310 against the lock ring 330. The lock ring 330, however, may be optional if an equivalent form of stopping mechanism, such as a catch key or the like formed in the sleeve 310 is employed. Different configurations of providing the neutral position of the sleeve 310 under similar principle are possible and not exhaustively enumerated here.

During operation, when the downhole device 210 is to shift flow paths to bypass the drill bit 132, a signal may be sent via rpm, for example, to the downhole device 210. The signal may be measured and/or processed in a microprocessor in the downhole device 210. The processor may then send a signal to the three-way valve and actuator 340 to change the pressure in the volume inlet 336. For example, the actuator 340 may increase or decrease the pressure in the volume 322.

In some embodiments, the actuator 340 may connect the volume inlet 336 to the annulus outlet 332 and equalize the pressures in the sliding sleeve volume 322 to the annulus 122. Because the pressure in the annulus 122 is lower than the pressure in the drill string 120 (often by 2000 psi), the pressure applied to external surfaces of the sleeve 310 (outside the volume 322) becomes greater than the pressure applied to inner surfaces of the sleeve 310 (surfaces forming the volume 322). The collective effect of this pressure difference would cause the sleeve 310 to compress the spring 320 and move toward the bypass outlet 312.

The spring 320 may have a desired elasticity such that the pressure difference between the drill string pressure and the annulus pressure may fully align the bypass port 314 to the bypass outlet 312. At least a portion of the drilling mud may bypass the drill bit 140 when the bypass port 314 is at least partially aligned with the bypass outlet 312. When the downhole device 210 sends a different rpm signal or stops sending a triggering signal, the actuator 340 (or its controller) may shift the sleeve 310 back to the neutral position, by reconnecting the drill string inlet 334 to the volume inlet 336. As such, the operation of the sleeve 310 need not be externally powered, and the operation may fully use the existing pressure differences between the drill string 120 and the annulus 122. The control and actuation of the three-way valve actuator 340 may be electrically powered like other downhole tools.

In some embodiments, the spring 320 may be a coil spring providing a biasing force corresponding to a threshold trigger pressure, i.e., a pressure balancing the force applied by the spring 320 to the sleeve 310. Once the pressure difference exceeds the threshold trigger pressure, the sleeve 310 may be moved toward the bypass outlet 312.

In some embodiments, the actuator 340 may be controlled in response to other signals besides rpm signals, such as an internal drill string pressure variation measured in a pressure transducer. For example, the internal drill string pressure variation satisfies a trigger condition for initiating a bypass of the drilling fluids. Sensors for measuring pressures, rpm, and other aspect of the downhole device 210 or the drill string 120 may be installed in various locations along the drill string 120, or may be onboard other tools of the drill string 120. Controller, power supply and other electronics are discussed in relation to FIG. 6 below.

Figure 4:
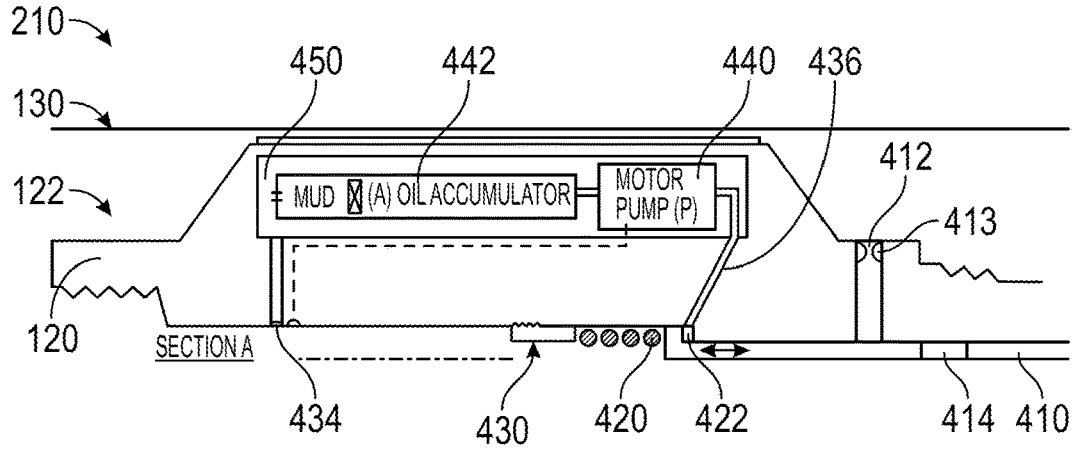
FIG. 4 shows a cross-sectional side view of a second exemplary embodiment of the downhole device.

FIG. 4 shows a cross-sectional side view of a second exemplary embodiment of the downhole device 210. Similar to the previous embodiment, the downhole device 210 includes a body as part of the drill string 120, a sleeve 410 sealingly slidable inside the body 120. The sleeve 410 may include at least one port 414 alignable with a corresponding bypass outlet 412 of the body 120. The bypass outlet 412 may include an erosion resistant nozzle 413. The downhole device 210 further includes a resilient member 420 (e.g., a spring) biasing the sleeve 410 against the body 120. The downhole device 210 further includes a motor driven pump 440 (herein called motor pump) that is configured to provide a pressure to the sleeve 410. The motor pump 440 can actuate the sleeve 410 to move relative to the body 120, such as to align the bypass outlet 412 with the port 414.

The downhole device 210 may have a neutral position where the sleeve 410 is biased toward the bypass outlet 412 and the bypass port 414 is offset from the bypass outlet 412. The sleeve 410 is pushed by the spring 420 secured at a lock ring 430 toward the bypass outlet, forming a volume 422 with the body 120. The volume 422 is connected to the motor pump 440 via a motor pump fluid line 436. In this embodiment, the pressure of the drilling fluids in the downhole device 210 bore (or the drill string 120) may communicate with an accumulator/pressure compensation vessel 442 (the "accumulator" 442). The accumulator 442 may actuate the adjacent piston to pressurize the internal oil in its oil chamber to the same pressure as that of the downhole device 210 (i.e., pressure inside the drill string 120). The accumulator 442 and the motor pump 440 may both be housed in a radial housing 450 of the body 120.

During operation, a microprocessor (e.g., included in the electronics 620 of FIG. 6) sends control signals to the motor pump 440. Upon receiving the control signals from the microprocessor, the motor pump 440 may pump pressurized oil from the accumulator 442 to the volume 422 via the motor pump fluid line 436. As such, the pumped oil pressure caused by the motor pump 440 may move the sleeve 410 to align the bypass port 414 with the bypass outlet 412. Because the drill string inlet 434 is hydraulically linked to the motor pump fluid line 436, the motor pump 440 needs not overcome the pressure in the drill string 120 and needs only overcome the bias force applied by the spring 420. When the bypass port 414 and the bypass outlet 412 are aligned, a portion of the drilling mud passing through the downhole device 210 is bypassed to the annulus 122.

Whenever rpm ceased the downhole device 210 may be and is typically programmed to close the bypass path.

In some embodiments, the microprocessor sends control signals based on preprogrammed rpm protocols. When the operator decides to put the downhole device 210 to sleep and stop the bypass flow from the bore to the annulus, then a different, pre-programmed rpm protocol would be performed. Such intent may be transmitted through the drill string 120 and recognized by an accelerometer connected to the microprocessor. The resulting signal may shut off the pump and allow the spring 420 to return the sleeve 410 to the original position to seal the bypass outlet 412.

In some embodiments, the actuation of the sleeve 410 by the motor pump 440 may include linear sliding motion, spiral sliding motion, rotational motion, or a combination thereof. For example, the bypass port 414 and the bypass outlet 412 may be apart linearly or radially in different embodiments. The motor pump 440 may employ various hydraulic actuators to move the sleeve 410, not limited to the disclosed examples.

Figure 5:
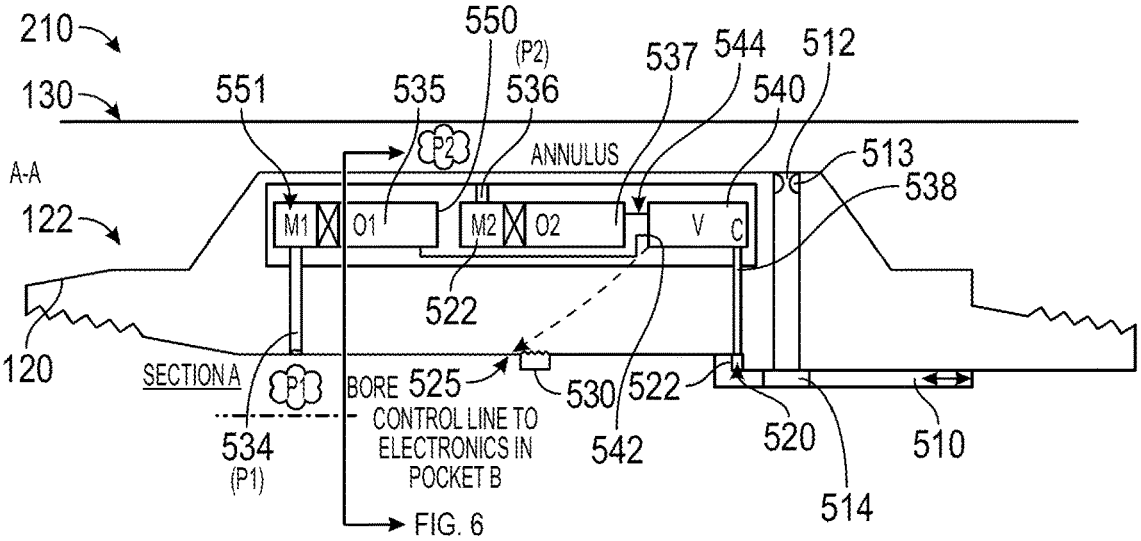
FIG. 5 shows a cross-sectional side view of a third exemplary embodiment of the downhole device.

FIG. 5 shows a cross-sectional side view of a third exemplary embodiment of the downhole device 210. Similar to the previous embodiments, the downhole device 210 in this embodiment also includes a body as part of the drill string 120, a sleeve 510 sealingly slidable inside the body 120. The sleeve 510 may include at least one port 514 alignable with a corresponding bypass outlet 512 of the body 120. The bypass outlet 512 may include an erosion resistant nozzle 513. The downhole device 210 further includes a resilient member 520 (e.g., a spring) biasing the sleeve 510 against the body 120. The downhole device 210 further includes a three-way valve 540 that is configured to provide a pressure to the sleeve 510 to actuate the sleeve 510 to move relative to the body 120, such as to align (as illustrated when bypass actuation conditions are met) the bypass outlet 512 with the port 514.

In FIG. 5, the body 120 includes a radial housing 550 for enclosing a bore pressure oil accumulator 535, an annulus pressure oil accumulator 537, and the three-way valve 540. The bore pressure oil accumulator 535 is connected to the drill string inlet 534 that is open to the bore to receive pressure therein. The bore pressure oil accumulator 535 may have mud from the drill string 120 to enter the volume 551 and apply pressure to the bore pressure oil accumulator 535. The bore pressure is communicated to the three-way valve 540 via the bore pressure oil accumulator inlet 542. The annulus pressure oil accumulator 537 is connected to the annulus inlet 536 to receive pressure therein. The annulus pressure oil accumulator 537 may have mud from the annulus 122 to enter the volume 552 and apply pressure to the annulus pressure oil accumulator 537. The annulus pressure is communicated to the three-way valve 540 via the annulus pressure oil accumulator inlet 544.

During operation, the pressure in the bore of the downhole device 210 is higher than the pressure in the annulus 122, often by about 1000-2000 psi. The bore pressure is communicated from the drill string inlet 534 through the bore pressure oil accumulator 535 to the three-way valve 540. Similarly, the pressure of the mud in the annulus between the downhole device 210 and the side surface 130 of the drilled hole is communicated to the volume 536 and the annulus pressure oil accumulator 537. The oil from the annulus pressure oil accumulator 537 is then communicated to the three-way valve 540.

The output port of the three-way valve 540 is shown as the sleeve volume inlet 538 and communicates, via the volume inlet 538, to the volume 522 between the sliding sleeve 510 and the downhole device 210's inner diameter, sealed by seals that allows for relative movement between the sleeve 510 and the body 120.

Inside that volume 522 is also a spring 520 which forces the sleeve 510 to the left (toward top of the downhole device 210) when there is no pressure differential between the bore and the volume 522, similar to the first embodiment shown in FIG. 3. When the three-way valve 540 relays the pressure from the drill string inlet 540 to the sleeve volume inlet 538, the sleeve 510 is positioned in a normally "closed" position.

Whenever an rpm protocol or other prescribed signal (pressure, bit weight, etc.) is sensed by one or more accelerometers and communicated to the microprocessor (both located in another pocket in the downhole device 210 (not shown) then the valve (V) is signaled to shift to the non-closed position. The three-way valve 540 communicates the pressure of the annulus 122 via the annulus pressure oil accumulator inlet 544 to the volume inlet 538 and thus to the volume 522. Because the annulus pressure can be said to be always lower than the internal flow in the tool, this lower pressure in the volume 522 shifts the sleeve 510 to the right as shown, aligning the bypass port 514 to the bypass outlet 512. This actuates the bypass flow and allows free flow of drilling fluids from the bore to the annulus.

When drilling mud bypass is no longer desired, then an rpm signal (or other types of signals) may be given, such as stopping the rotation entirely. The accelerometer measures such signals and the microprocessor processes the measured signals to determine a corresponding control output. The three-way valve 540 may then be controlled to shift back to the original closed position. This is achieved by communicating the bore pressure from the drill string inlet 534 to the volume 522 (which are identical pressures) and allowing the spring 520 to move the sleeve 510 to offset the bypass port 514 from the bypass outlet 512, sealing off the bypass flow.

Figure 6:
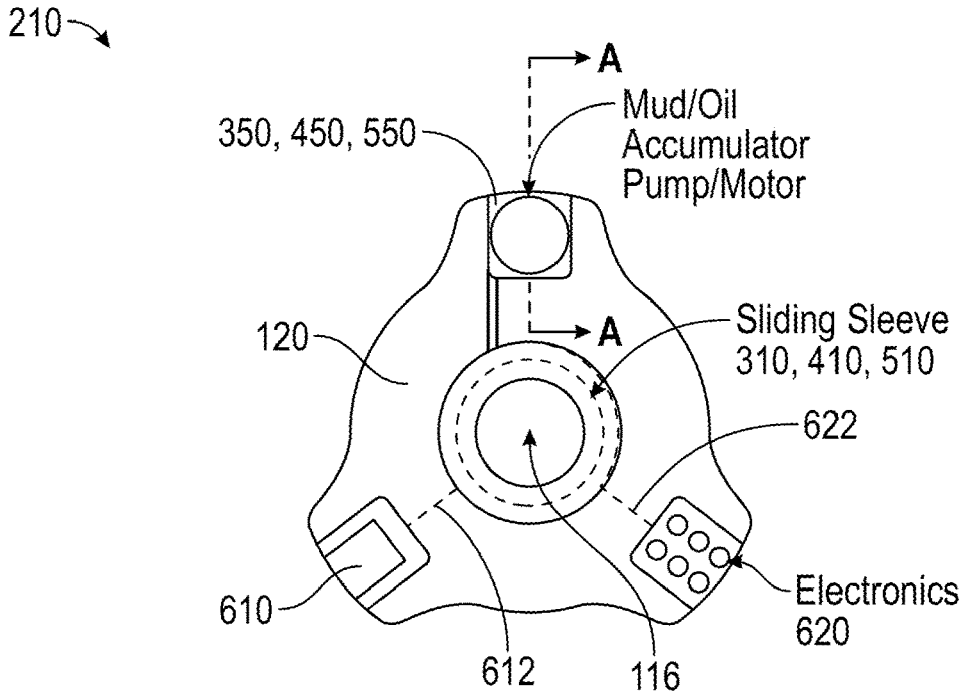
FIG. 6 shows a cross-sectional top view of an exemplary embodiment of the downhole device.

FIG. 6 shows a cross-sectional top view of an exemplary embodiment of the downhole device 210. The configuration shown in FIG. 6 is applicable to the previous embodiments discussed in FIGS. 3-5. For example, the downhole device 210 may include one or more radial housing 350, 450, or 550 for containing the actuator 340, 440, or 540. The downhole device 210 may include an internal tube (e.g., the internal cylindrical surface) housing the sleeve 310, 410, or 510.

As shown, the downhole device 210 includes three radial housings, possibly equally spaced 120 degrees apart. In some embodiments, one or more, such as two, or four, or another different number of radial housings may be used instead of three. The radial housing 350, 450, or 550 may each include one or more, or all the component(s) of the bypass actuation system without preference or limitations. For example, the radial housing 350, 450, or 550 may include at least one of an oil accumulator, a motor pump, a battery 610, the actuator, the three-way valve, or motor pump 340, 440, or 540, or the controller/electronics 620 as discussed above.

In some embodiments, the battery 610, the electronics 620, and the actuators 340, 440, and 540 may respectively be connected by a wire 612 and a control line 622. For example, the control line 622 may be embedded in a bored hole or holes in the body 120 around the sleeve 310, 410, or 510 to reach the corresponding radial housing 350, 450, or 550. In some embodiments, the power line 612 may connect directly with the actuator or motor pump 340, 440, or 540. In other embodiments, the power line 612 may connect directly with the electronics 620. In other embodiments, the power line 612 may connect indirectly with the actuator or motor pump 340, 440, or 540 via the electronics 620. Other arrangements are possible. In some implementations, wireless communication for receiving sensing signals and sending control signals may be employed between the electronics 620 and the actuator or pump 340, 440, or 540. Although the battery 610, the electronics 620, and the actuator or pump 340, 440, or 540 are shown to be separately placed in individual radial housings 350, 450, or 550, they may be reconfigured to share one or more radial housings as desired.

Figure 7A:
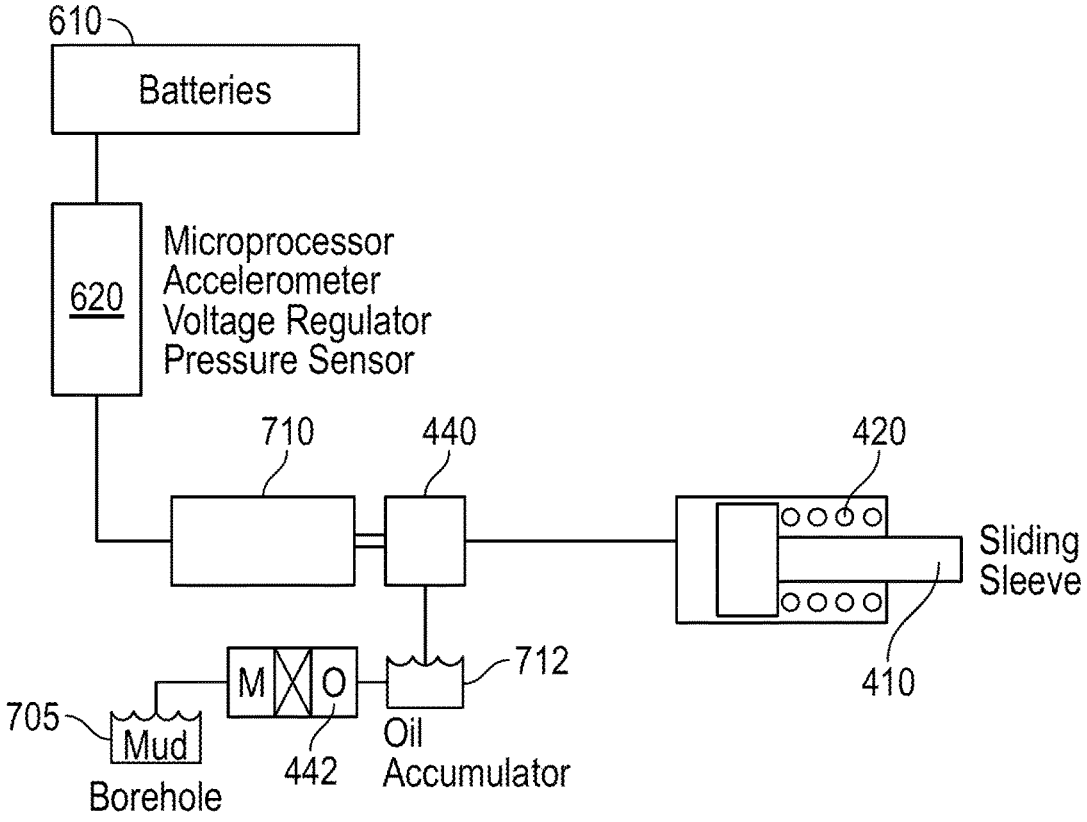
FIG. 7A shows an exemplary schematic for controlling the downhole device.

FIG. 7A illustrates an exemplary schematic for controlling the downhole device 210 as shown in FIGS. 3-6. The electronics 620 may include a microprocessor, one or more accelerometers, a voltage regulator, and a pressure sensor, for example. In some embodiments, the illustrated schematic applies to FIG. 4. For example, the electronics 620 may send control signals to a motor or actuator 710 that is operable to power the motor pump 440. Details of data acquisition and generation of the control signals may reference U.S. Pat. No. 9,879,518, specifically, FIGS. 5, 6, and 6A and the corresponding descriptions.

Upon receiving power or actuation from the actuator 710, the motor pump 440 may communicate pressurized oil from the oil reservoir or accumulator 712 to actuate the sleeve 410 to overcome the bias force by the spring 420 and to align bypass port 414 with bypass outlet 412. The mud 705 in borehole is communicated to the oil accumulator 442 that provides the pressurized oil to the oil accumulator 712. Different configurations are possible in view of the bypass method discussed below.

Figure 7B:
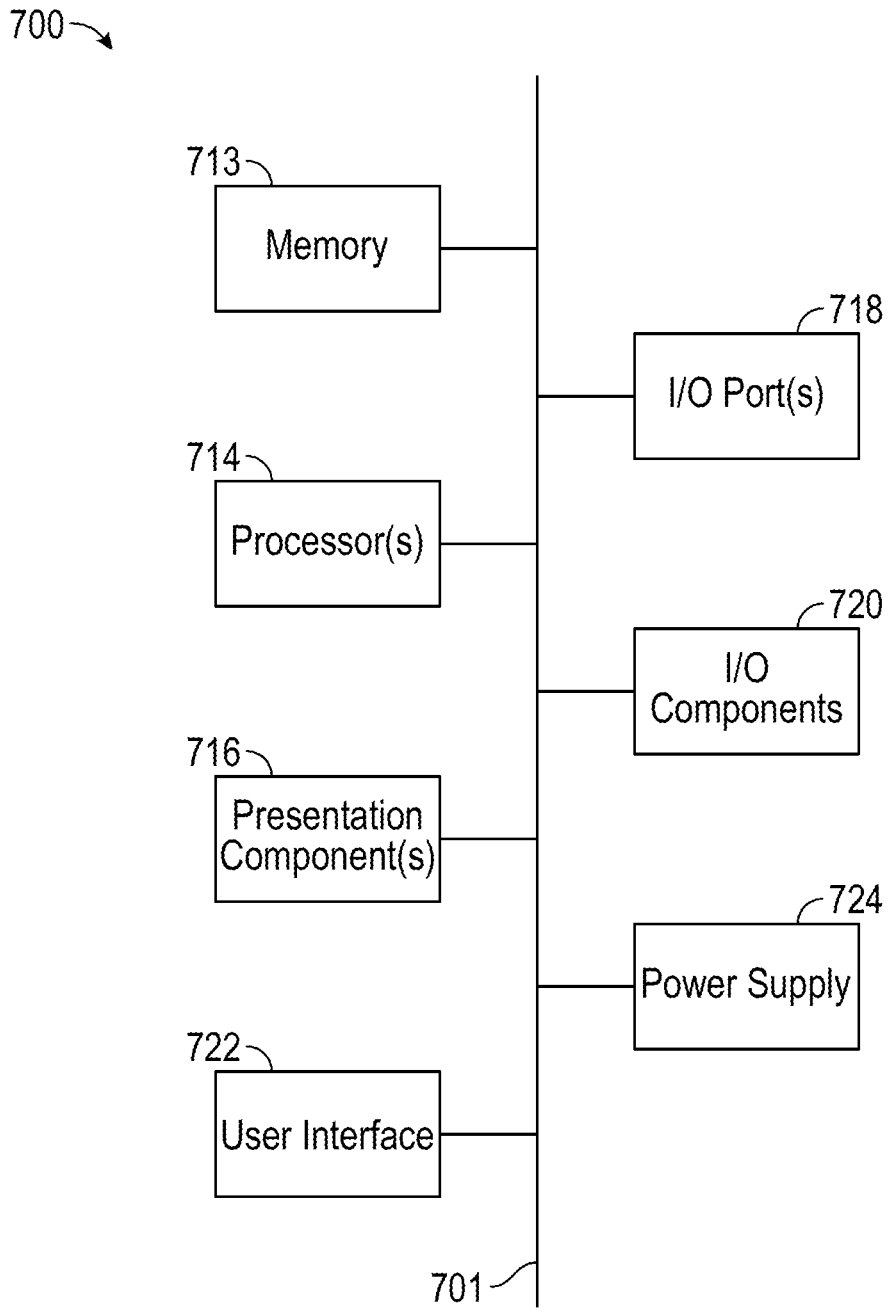
FIG. 7B shows an exemplary schematic of a controller applicable to the downhole device.

FIG. 7B shows an exemplary schematic of a controller 700 of the electronics 620 applicable to the downhole device 210. Referring to the drawings in general, and initially to FIGS. 7A and 7B in particular, the controller 700 is but one example of a suitable configuration for the electronics 620 and is not intended to suggest any limitation as to the scope of use or functionality of this disclosure. Neither should the controller 700 be interpreted as having any dependency or requirement relating to any one or combination of components illustrated.

Embodiments of this disclosure may be described in the general context of computer code or machine-executable instructions stored as program modules or objects and executable by one or more computing devices, such as a laptop, server, mobile device, tablet, etc. Generally, program modules including routines, programs, objects, components, data structures, etc., refer to code that perform particular tasks or implement particular abstract data types. Embodiments of this disclosure may be practiced in a variety of system configurations, including handheld devices, consumer electronics, general-purpose computers, more specialty computing devices, and the like. Embodiments of this disclosure may also be practiced in distributed computing environments where tasks may be performed by remote-processing devices that may be linked through a communications network.

With continued reference to FIG. 7B, the controller 700 of the downhole device 210 includes a bus 701 that directly or indirectly couples the following devices: memory 713, one or more processors 714, one or more presentation components 716, one or more input/output (I/O) ports 718, I/O components 720, a user interface 722 and an illustrative power supply 724 (such as the battery 610 of FIG. 6). The presentation components 716 and the user interface 722 may be above ground and connected to the bus 701 remotely or when the tool is located above ground for servicing. The bus 701 represents what may be one or more busses (such as an address bus, data bus, or combination thereof).

Although the various blocks of FIG. 7B are shown with lines for the sake of clarity, in reality, delineating various components is not so clear, and metaphorically, the lines would more accurately be fuzzy. For example, one may consider a presentation component such as a display device to be an I/O component. Additionally, many processors have memory. The diagram of FIG. 7B is merely illustrative of an exemplary computing device that can be used in connection with one or more embodiments of the present invention. Further, a distinction is not made between such categories as "workstation," "server," "laptop," "mobile device," etc., as all are contemplated within the scope of FIG. 7B and reference to "computing device."

The controller 700 of the downhole device 210 typically includes a variety of computer-readable media. Computer-readable media can be any available media that may be accessed by the controller 700 and include both volatile and nonvolatile media, removable and non-removable media. By way of example, and not limitation, computer-readable media may comprise computer-storage media and communication media.

The computer-storage media includes volatile and nonvolatile, removable and non-removable media implemented in any method or technology for storage of information such as computer-readable instructions, data structures, program modules, or other data. Computer-storage media includes, but is not limited to, Random Access Memory (RAM), Read Only Memory (ROM), Electronically Erasable Programmable Read Only Memory (EEPROM), flash memory or other memory technology, CD-ROM, digital versatile disks (DVD) or other holographic memory, magnetic cassettes, magnetic tape, magnetic disk storage or other magnetic storage devices, or any other medium that can be used to encode desired information and which can be accessed by the controller 700.

The memory 713 includes computer-storage media in the form of volatile and/or nonvolatile memory. The memory 713 may be removable, non-removable, or a combination thereof. Suitable hardware devices include solid-state memory, hard drives, optical-disc drives, etc. The controller 700 of the downhole device 210 includes one or more processors 714 that read data from various entities such as the memory 713 or the I/O components 720.

The presentation component(s) 716 present data indications to a user or other device. In an embodiment, the controller 700 outputs present data indications including separation rate, temperature, pressure and/or the like to a presentation component 716. Suitable presentation components 716 include a display device, speaker, printing component, vibrating component, and the like.

The user interface 722 allows the user to input/output information to/from the controller 700. Suitable user interfaces 722 include keyboards, key pads, touch pads, graphical touch screens, and the like. For example, the user may input a type of signal profile into the controller 700 or output a separation rate to the presentation component 716 such as a display. In some embodiments, the user interface 722 may be combined with the presentation component 716, such as a display and a graphical touch screen. In some embodiments, the user interface 722 may be a portable hand-held device. The use of such devices is well known in the art.

The one or more I/O ports 718 allow the controller 700 to be logically coupled to other devices including the accelerometers, pressure sensors, rpm sensors, and other I/O components 720, some of which may be built in. Examples of other I/O components 720 include a control terminal above the ground, the actuators 340, 440, and 540, wireless device, other sensors, and actuators in the drill string 120, and the like. During operation, for example, the I/O ports 718 enables the controller 700, via the control line 622, for example, to operate on the three-way valves 340 and 540 to alter the connection between different ports.

Any suitable controller may be used with this invention. For example, U.S. Pat. No. 9,879,518 discloses an intelligent reamer for drilling using rotation sensor, fluid operation sensor, and a control scheme based on the measured rotational rate of the drill string (e.g., an rpm protocol). The U.S. Pat. No. 9,879,518 disclosure regarding the data acquisition, sensing, signal transmission, signal processing, control, and other technical aspects in the that patent are hereby cited as background and incorporated by reference to the extent that they is not inconsistent with this invention.

Figure 8A:
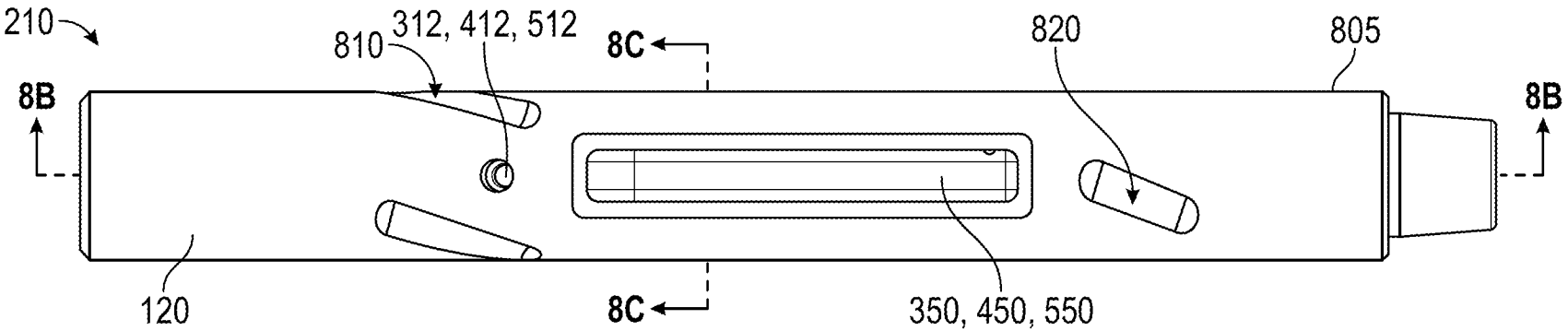
FIG. 8A shows a side view of an exemplary embodiment of the downhole device having carved structures for regulating the annular fluid flow.
Figure 8B:
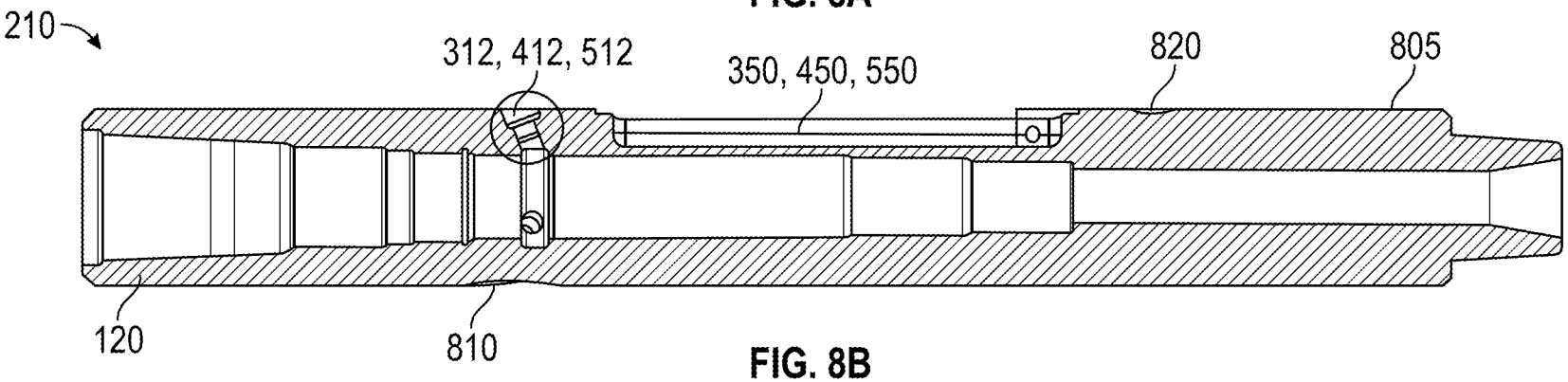
FIG. 8B shows a cross-sectional side view of the exemplary embodiment of the downhole device shown in FIG. 8A.
Figure 8C:
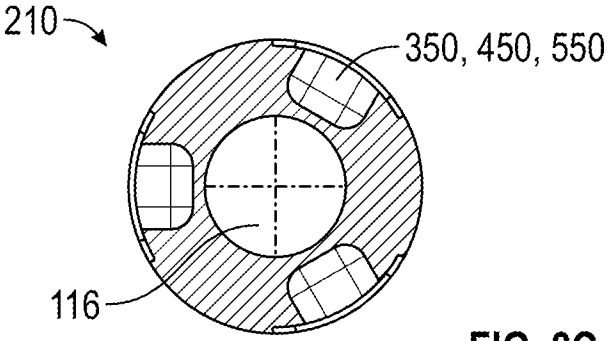
FIG. 8C shows a cross-sectional top view of the exemplary embodiment of the downhole device shown in FIG. 8A.

FIG. 8A shows a side view of an exemplary embodiment of the downhole device 210 having carved structures 810 and 820 for regulating the annular fluid flow. FIG. 8B shows a cross-sectional side view, and FIG. 8C shows a cross-sectional top view of the same. The carved structures 810 and 820 may be slots carved on the external surface of the body 805 of the downhole device 210. The carved structure 820 is lower than the carved structure 810 when the example downhole device 210 is positioned in an erected orientation. The carved structures 810 and 820 may motivate the annular flow of the drilling fluids upward. For example, the carved structures 810 and 820 form helical profiles that when the carved structures 810 and 820 are rotated clockwise (viewing downward into the well), the fluids in the carved structures 810 and 820 would receive an upward actuation. This may be similar to a full coverage stabilizer or a spiral collar.

In some embodiments, the carved structures 810 and 820 may cause turbulence to bring the cuttings off the wall and allow the upward flow from the bit to carry them upward in the well. In some embodiments, the carved structure 810 may intersect with the bypass outlet 312, 412, or 512 to provide the helical motion of the circulated drill fluids in the annulus 122 from the outset. Although FIG. 8A illustrates the carved structures 810 and 820 to be certain helical shape, different shapes, such as the varying degrees of helical angles, may be used, as long as they form a general axial arrangement. In some embodiments, the carved structures 810 and 820 may have a substantial depth based on the wall thickness, as shown in FIG. 8B.

Alternative Exemplary Downhole Device

Figure 10A:
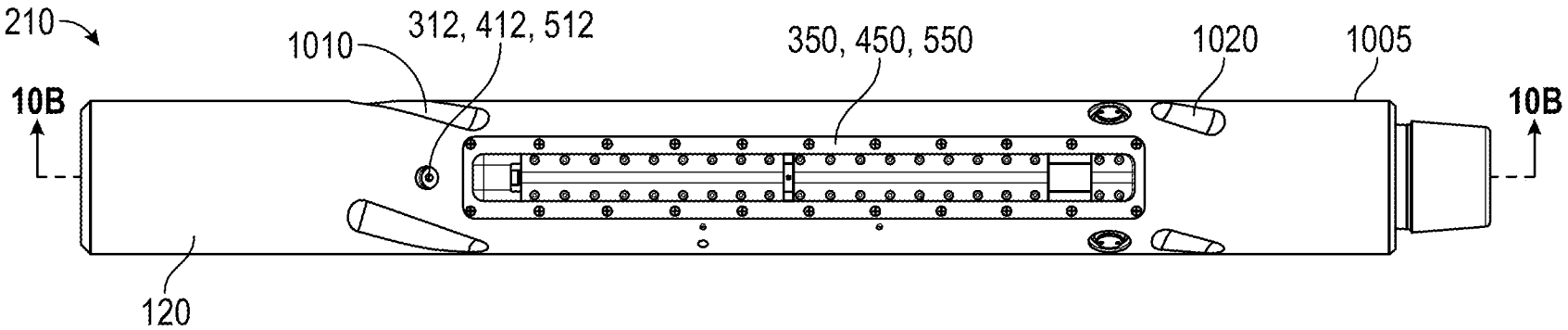
FIG. 10A shows a side view of an exemplary embodiment of an alternative downhole device having carved structures for regulating annular fluid flow.
Figure 10B:
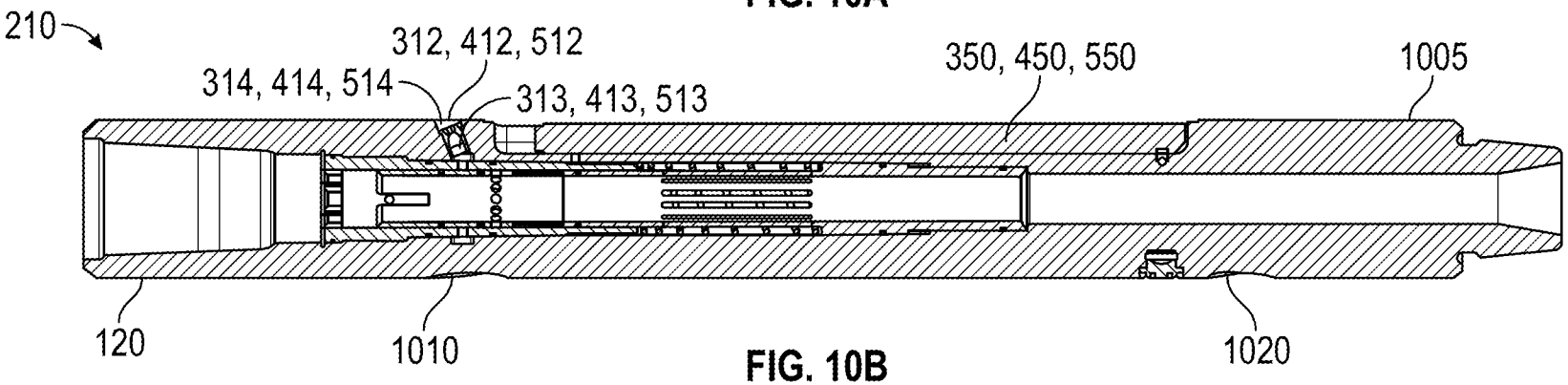
FIG. 10B shows a cross-sectional side view of the exemplary embodiment of the downhole device shown in FIG. 10A.
Figure 10C:
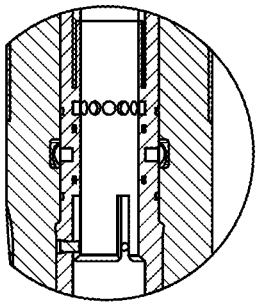
FIG. 10C shows a detailed view cross-sectional top view of the exemplary embodiment of the downhole device shown in FIG. 10B.

FIG. 10A shows a side view of an exemplary embodiment of an alternative downhole device 210 having carved structures 1010 and 1010 for regulating annular fluid flow. FIG. 10B shows a cross-sectional side view, and FIG. 10C shows a cross-sectional top view of the same. The carved structures 1010 and 1020 may be slots carved on the external surface of the body 1005 of the downhole device 210. The carved structure 1020 is lower than the carved structure 1010 when the example downhole device 210 is positioned in an erected orientation. The carved structures 1010 and 1020 may motivate the annular flow of the drilling fluids upward. For example, the carved structures 1010 and 1020 form helical profiles that when the carved structures 1010 and 1020 are rotated clockwise (viewing downward into the well), the fluids in the carved structures 1010 and 1020 would receive an upward actuation. This may be similar to a full coverage stabilizer or a spiral collar.

In some embodiments, the carved structures 1010 and 1020 may cause turbulence to bring the cuttings off the wall and allow the upward flow from the bit to carry them upward in the well. In some embodiments, the carved structure 1010 may intersect with the bypass outlet 312, 412, or 512 to provide the helical motion of the circulated drill fluids in the annulus 122 from the outset. Although FIG. 10A illustrates the carved structures 1010 and 1020 to be certain helical shape, different shapes, such as the varying degrees of helical angles, may be used, as long as they form a general axial arrangement. In some embodiments, the carved structures 1010 and 1020 may have a substantial depth based on the wall thickness, as shown in FIG. 10B.

Method of Making Downhole Device

Figure 13:
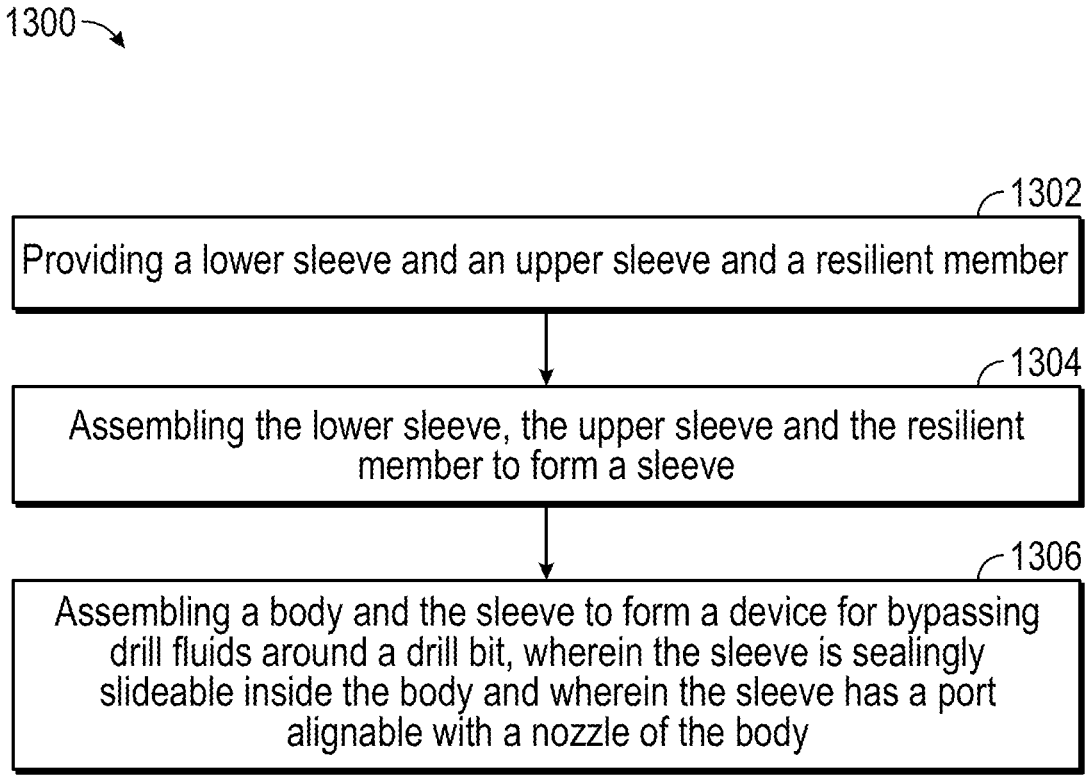
FIG. 13 shows a method of making the downhole device.

FIG. 13 shows a method of making the downhole device 1300. As shown in FIG. 13, a method of making a device for bypassing fluids around a drill bit 1300 may include: providing a lower sleeve, an upper sleeve and a resilient member 1302 (see e.g., FIGS. 11A-11B); assembling the lower sleeve, the upper sleeve and the resilient member to form a sleeve 1304 (see e.g., FIGS. 11C-1 & 11C-2); and assembling a body and the sleeve to form the device for bypassing drill fluids around the drill bit 1306 (see e.g., FIGS. 11D-11E). In an embodiment, the sleeve 310, 410 and 510 may be sealingly slideable inside the body 1105. Id. In an embodiment, the sleeve 310, 410 and 510 has a bypass port 314, 414 and 514 alignable with an erosion resistant nozzle 313, 413 and 513 of the body 1105. Id.

In some embodiments, the resilient member comprises a spring 320, 420 and 520.

Figure 11A:
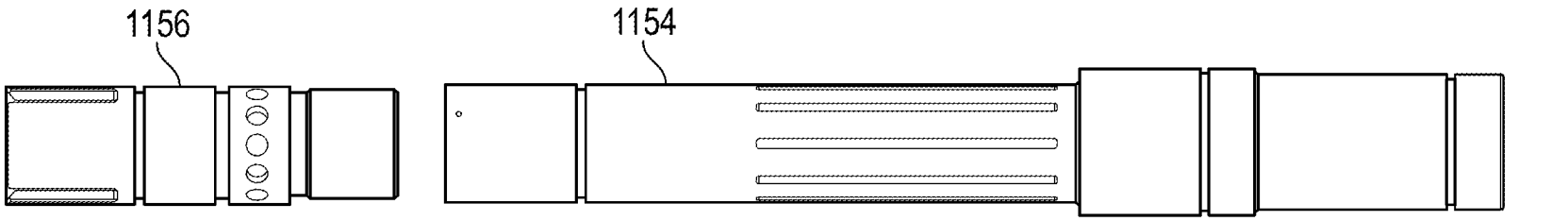
FIG. 11A shows a top view of a lower sleeve and an upper sleeve of an alternative exemplary embodiment of the downhole device shown in FIGS. 10A-10C prior to a first step of assembly.
Figure 11B:
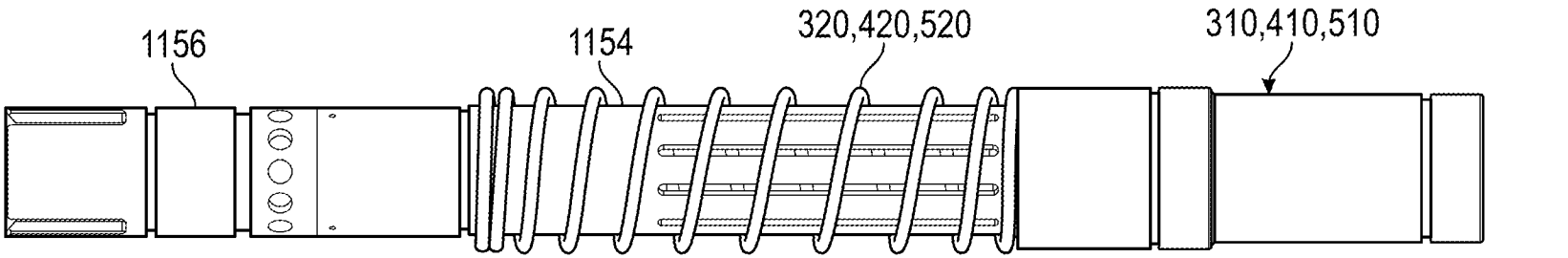
FIG. 11B shows a top view of the lower sleeve, the upper sleeve and a spring of the exemplary embodiment of the downhole device shown in FIG. 11A after the first step of assembly.

FIG. 11A shows a side view of a lower sleeve and an upper sleeve of an alternative exemplary embodiment of the downhole device 210 having carved structures 1110 and 1120 for regulating fluid flow prior to a first step of assembly. See e.g., FIGS. 11D-11E: 1110 & 1120. FIG. 11B shows a side view of the lower sleeve, the upper sleeve and a spring of the downhole device 210 shown in FIG. 11A after the first step of assembly.

As shown in FIGS. 11A-11B, the sleeve 310, 410 and 510 of the downhole device 210 includes: a lower sleeve 1154, an upper sleeve 1156 and a resilient member. In some embodiments, the resilient member comprises a spring 320, 420 and 520.

In some embodiments, the lower sleeve 1154 and the upper sleeve 1156 are attached via a connection. See e.g., FIG. 11A. In some embodiments, the lower sleeve 1154 and the upper sleeve 1156 are removably attached via a threaded connection. Id. In some embodiments, the lower sleeve 1154 and the upper sleeve 1156 are removably attached via a threaded connection and a set screw. Id.

Figures 1, 11C:
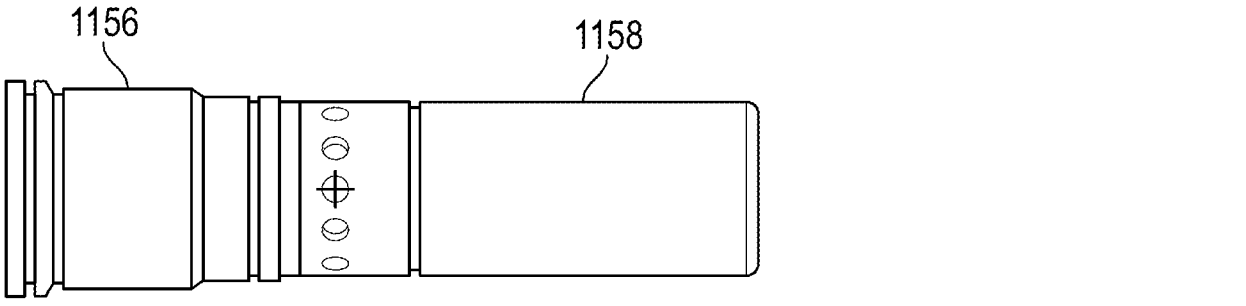
Figures 2, 11C:
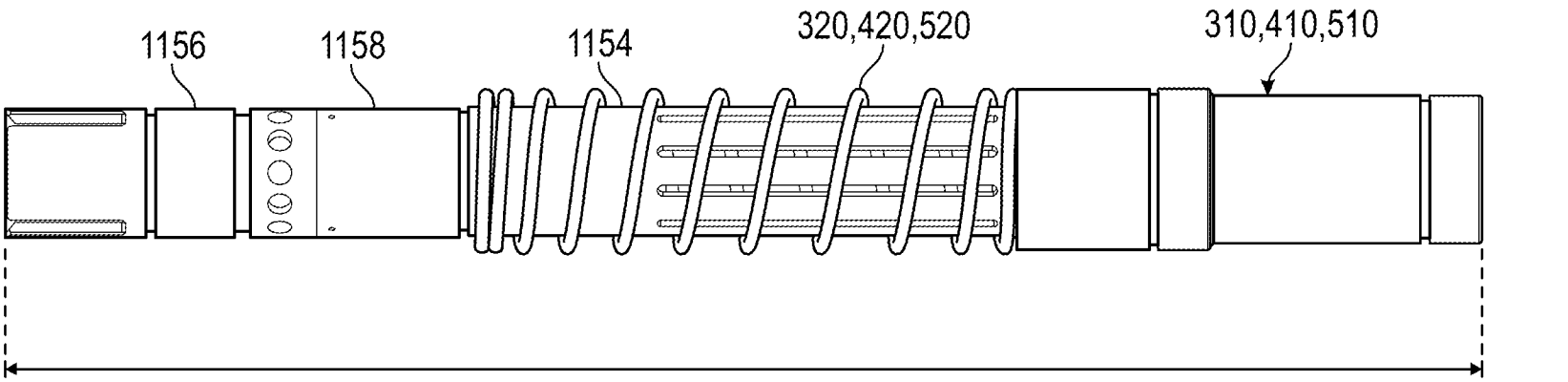
Figure 11D:
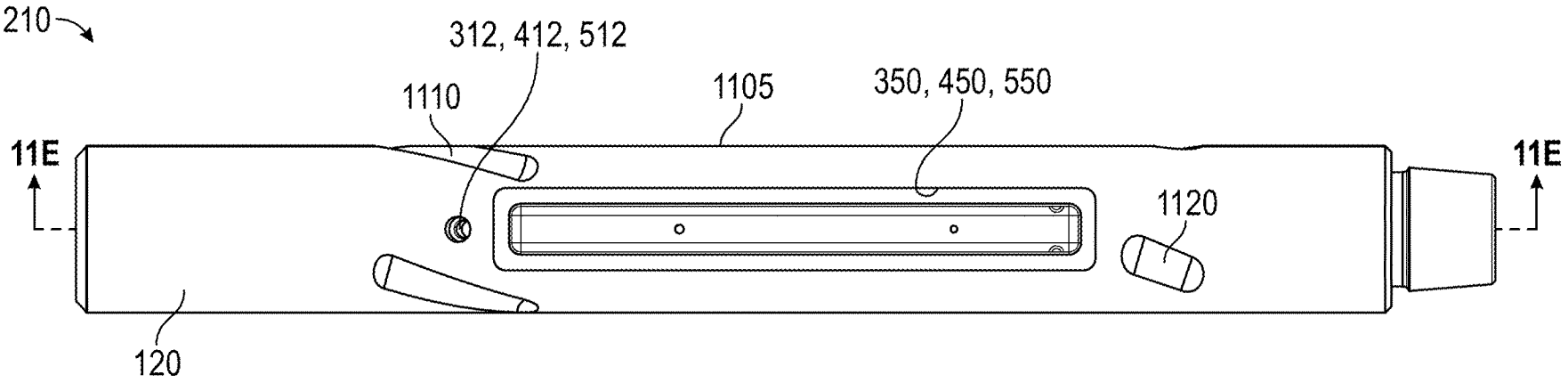
FIG. 11D shows a side view of a body of the exemplary embodiment of the downhole device prior to a second step of assembly.
Figure 11E:
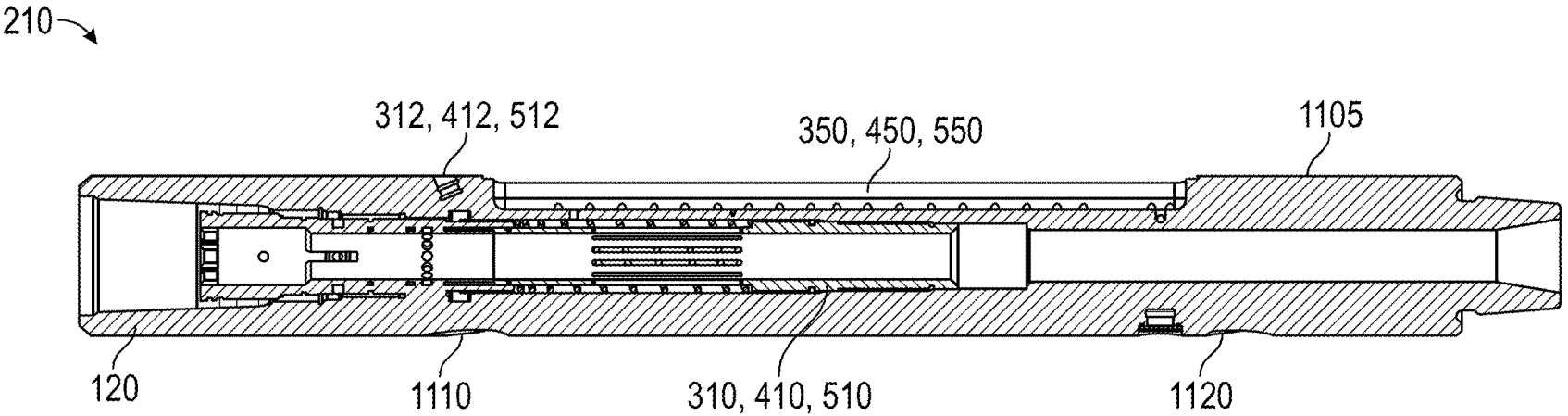
FIG. 11E shows a cross-sectional view of the body and the sleeve of the exemplary embodiment of the downhole device of FIGS. 11A-11D after the second step of assembly.

FIG. 11C-1 shows a side view of a stop block of the downhole device 210 shown in FIGS. 11A-11B; FIG. 11C-2 shows a side view of the assembled sleeve of the exemplary embodiment of the downhole device 210 shown in FIG. 11B; and FIG. 11D shows a side view of a body and the sleeve of the downhole device 210 prior to a second step of assembly. FIG. 11E shows a cross-sectional view of the body and the sleeve of the downhole device 210 of FIGS. 11A-11D after the second step of assembly.

As shown in FIGS. 11C-1 and 11C-2, the sleeve 310, 410 and 510 of the downhole device 210 includes: a lower sleeve 1154, an upper sleeve 1156 and a resilient member. In some embodiments, the resilient member comprises a spring 320, 420 and 520. See e.g., FIG. 11C-2.

In some embodiments, the upper sleeve 1156 comprises a stop block 1158. In some embodiments, the upper sleeve 1156 comprises a stop block 1158 for the spring 320, 420 and 520.

As shown in FIGS. 11D-11E, the downhole device 210 comprises a body 1105 and the sleeve 310, 410 and 510. In some embodiment, the downhole device 210 comprises a body 1158 (see FIGS. 11C-1 & 11C-2: 1158) having carved structures 1110 and 1120. See e.g., FIGS. 11D-11E: 1110 & 1120.

In an embodiment, the downhole device 210 further comprises a bypass outlet 312, 412 and 512 and a radial housing 350, 450 and 550.

As shown in FIG. 11E, the body 1105 and the sleeve 310, 410 and 510 are attached via a connection. See e.g., FIG. 11D. In some embodiment, the body 1105 and the sleeve 310, 410, 510 are attached via a threaded connection. Id.

Figure 11F:
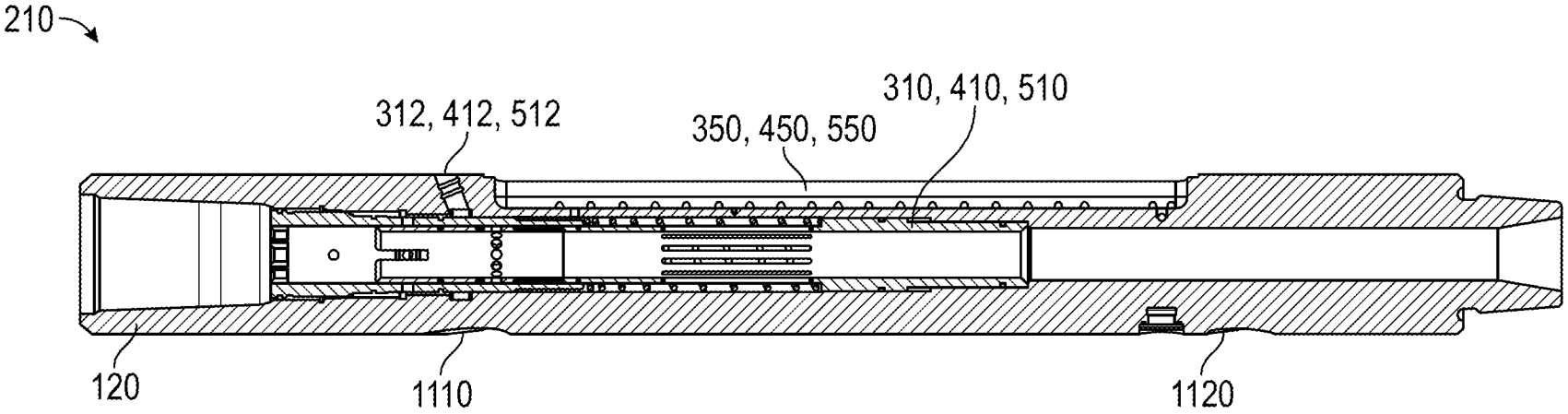
FIG. 11F shows a cross-sectional view of the body and the sleeve of the exemplary embodiment of the downhole device shown in FIG. 11E prior to a third step of assembly.
Figure 11G:
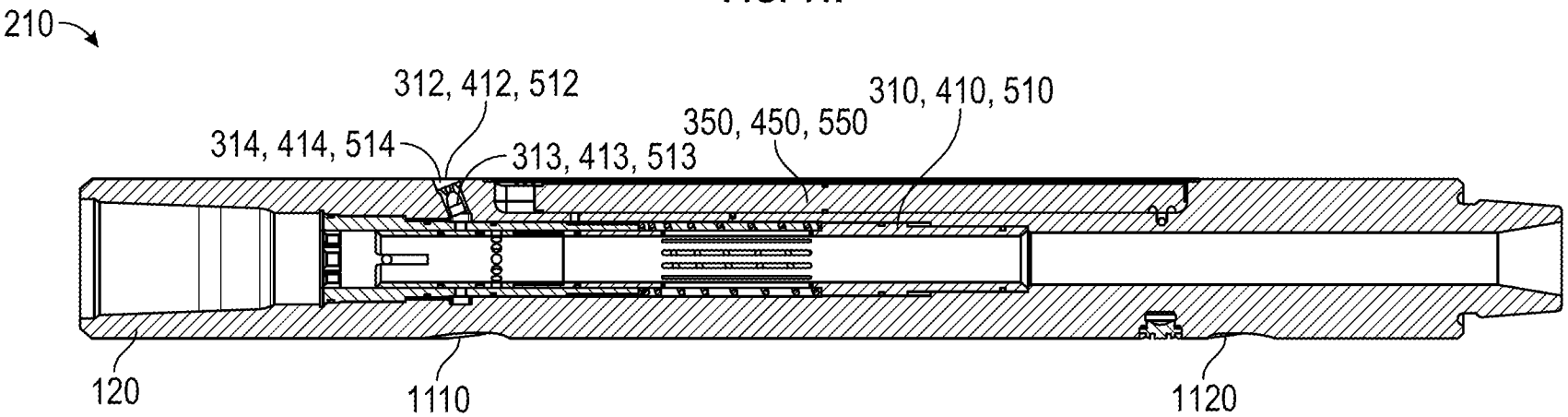
FIG. 11G shows a cross-sectional view of the exemplary embodiment of the downhole device of FIGS. 11A-11F after the third step of assembly.

FIG. 11F shows a cross-sectional view of the body 1105 and the sleeve 310, 410 and 510 of the downhole device 210 shown in FIG. 11E prior to a third step of assembly. FIG. 11G shows a cross-sectional view of the downhole device 210 of FIGS. 11A-11F after the third step of assembly.

As shown in FIGS. 11F and 11G, the body 1105 and the sleeve 310, 410 and 510 are attached via a connection. See e.g., FIGS. 11D-11E: 1105. In some embodiment, the body 1105 and the sleeve 310, 410, 510 are attached via a threaded connection. Id. In some embodiments, the body 1105 and the sleeve 310, 410 and 510 are attached via threaded connection and a snap ring. See e.g., FIG. 11G.

Method for Bypassing Drilling Fluids Using the Downhole Device

Figure 9:
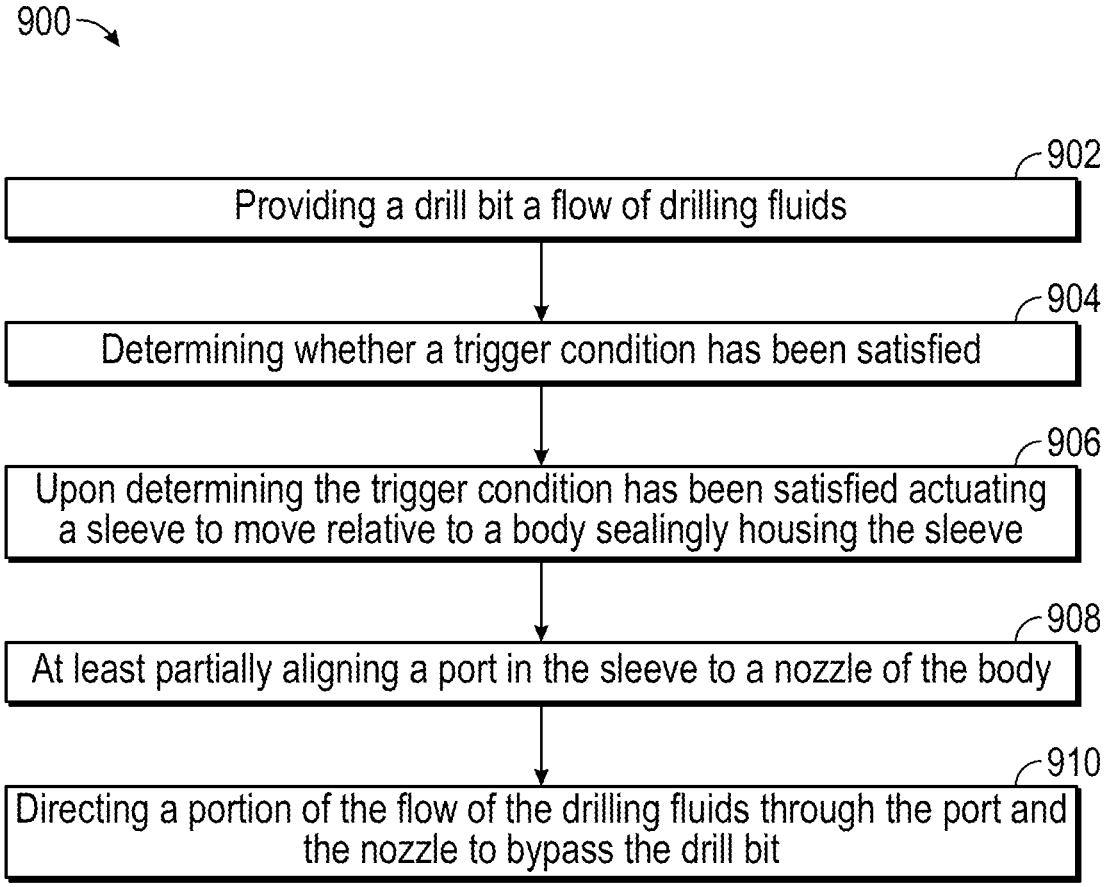
FIG. 9 shows a flow diagram of a method for bypassing drilling fluids from a downhole drill bit.

FIG. 9 shows a flow diagram of a method for bypassing drilling fluids from a downhole drill bit 900. As shown in FIG. 9, the method for bypassing drilling fluids from a downhole drill bit 900 may include: providing a drill bit a flow of drilling fluids 902; determining whether a trigger condition has been satisfied 904; upon determining the trigger condition has been satisfied, actuating a sleeve to move relative to a body sealingly housing the sleeve 906, and at least partially aligning a port in the sleeve to a nozzle of the body 908; and directing a portion of the flow of drilling fluids through the port and the nozzle to bypass the drill bit 910. In an embodiment, the flow of drilling fluids returns in an annulus.

In some embodiments, determining the satisfaction of the trigger condition 904 may include measuring a value related to a rotation speed of the downhole drill bit or a pressure of the drilling fluids or weight and comparing the measured value to a reference value.

In some other embodiments, determining the satisfaction of the trigger condition 904 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 904 may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some embodiments, actuating the sleeve to move relative to the body 906 comprises actuating a three-way valve in response to the pressure difference between the drilling fluids inside the drill string and the drilling fluids in the annulus.

In some embodiments, actuating the sleeve to move relative to the body 906 may include sliding the sleeve inside the body, or rotating the sleeve inside the body, or both.

In some embodiments, the method further includes biasing the sleeve against the body to close the port from the nozzle upon determining the trigger condition has not been satisfied.

In some other embodiments, biasing the sleeve against the body to close the port from the nozzle may include offsetting the port from the nozzle using a spring.

Method for Bypassing Drilling Fluids Using the Alternative Downhole Device

Figure 12:
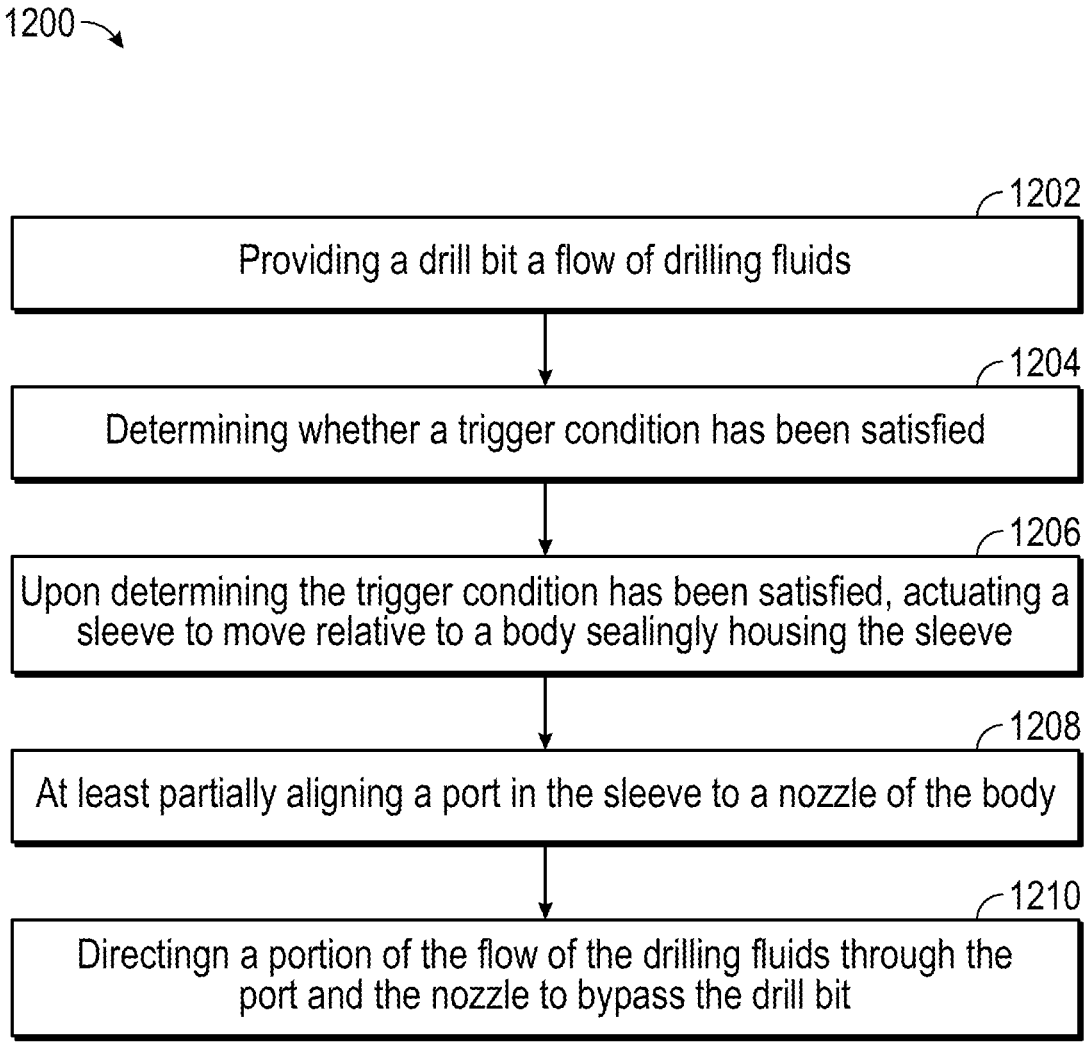
FIG. 12 shows a flow diagram of a method for bypassing drilling fluids from a downhole drill bit.

FIG. 12 shows a flow diagram of a method for bypassing drilling fluids from a downhole drill bit 1200. As shown in FIG. 12, the method for bypassing drilling fluids from a downhole drill bit 1200 may include: providing a drill bit a flow of drilling fluids 1202; determining whether a trigger condition has been satisfied 1204; upon determining the trigger condition has been satisfied, actuating a sleeve to move relative to a body sealingly housing the sleeve 1206, and at least partially aligning a port in the sleeve to a nozzle of the body 1208; and directing a portion of the flow of drilling fluids through the port and the nozzle to bypass the drill bit 1210. In an embodiment, the flow of drilling fluids returns in an annulus. In an embodiment, a resilient member comprises a spring providing a biasing force corresponding to a threshold trigger pressure.

In some embodiments, determining the satisfaction of the trigger condition 1204 may include measuring a value related to a rotation speed of the downhole drill bit or a pressure of the drilling fluids or weight and comparing the measured value to a reference value.

In some other embodiments, determining the satisfaction of the trigger condition 1204 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 1204 may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some embodiments, actuating the sleeve to move relative to the body 1206 comprises actuating a three-way valve in response to the pressure difference between the drilling fluids inside the drill string and the drilling fluids in the annulus.

In some embodiments, actuating the sleeve to move relative to the body 1206 may include sliding the sleeve inside the body, or rotating the sleeve inside the body, or both.

In some embodiments, the method further includes biasing the sleeve against the body to close the port from the nozzle upon determining the trigger condition has not been satisfied.

In some other embodiments, biasing the sleeve against the body to close the port from the nozzle may include offsetting the port from the nozzle using a coil spring.

In the foregoing description of certain embodiments, specific terminology has been resorted to for the sake of clarity. However, the disclosure is not intended to be limited to the specific terms so selected, and it is to be understood that each specific term includes other technical equivalents, which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

Incorporation by Reference

All patents and patent applications, articles, reports, and other documents cited herein are fully incorporated by reference to the extent they are not inconsistent with this invention.

What is claimed is:

1. A device for bypassing drill fluids around a drill bit, the device comprising:

a sleeve sealingly slidable inside a body, the sleeve having a port alignable with a nozzle of the body;

a resilient member biasing the sleeve against the body;

an actuator configured to provide a pressure to the sleeve and actuate the sleeve to move relative to the body; and a controller configured to operate the actuator to actuate the sleeve to move relative to the body in response to a change of a monitored operation condition;

wherein the controller is configured to monitor the change of a monitored operation condition by comparing a pressure of drilling fluids inside the drill string in an accumulator or pressure compensator, and a pressure of the drilling fluids in the annulus outside the drill string in another accumulator or pressure compensator to ascertain a pressure difference.

2. The device of claim 1, wherein the resilient member comprises a spring providing a biasing force corresponding to a threshold trigger pressure.

3. The device of claim 1, wherein the sleeve is configured to direct drill fluids to the drill bit when the port is not aligned with the nozzle of the body and is configured to direct a portion of the drill fluids to the drill bit when the port becomes at least partially aligned with the nozzle of the body such that another portion of the drill fluids bypasses the drill bit.

4. The device of claim 1, further comprising a lock ring setting a movement limit to the sleeve.

5. The device of claim 1, wherein the body comprises an internal tube housing the sleeve and at least one radial compartment housing at least one of an oil accumulator, a motor pump, a battery, the actuator, or the controller.

6. The device of claim 1, wherein the actuator includes a three-way control valve.

7. The device of claim 1, wherein the actuator includes an accumulator, a pressure compensator, or both.

8. The device of claim 1, wherein the controller is configured to operate the actuator to actuate the sleeve to move relative to the body in response to an internal drill string pressure variation measured in a pressure transducer, wherein the internal drill string pressure variation satisfies a trigger condition.

9. The device of claim 1, wherein the body comprises helical carved structures distributed radially on an external surface of the body.

10. The device of claim 9, wherein the helical carved structures are configured to facilitate flow of the drill fluids bypassed the drill bit.

11. A method for controlling drilling fluids in a drill string to bypass a drill bit, the method comprising:

providing the drill bit a flow of drilling fluids in the drill string, wherein the flow of drilling fluids returns in an annulus;

determining whether a trigger condition has been satisfied;

upon determining the trigger condition has been satisfied, actuating a sleeve to move relative to a body sealingly housing the sleeve, and at least partially aligning a port in the sleeve to a nozzle of the body; and directing a portion of the flow of drilling fluids through the port and the nozzle to bypass the drill bit;

wherein determining the trigger condition being satisfied comprises comparing a pressure of the drilling fluids inside the drill string and a pressure of the drilling fluids in the annulus outside the drill string to ascertain a pressure difference, and wherein actuating the sleeve to move relative to the body comprises actuating a three-way valve in response to the pressure difference between the drilling fluids inside the drill string and the drilling fluids in the annulus, and wherein comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

12. The method of claim 11, wherein determining the trigger condition being satisfied further comprises measuring a value related to a rotation speed of the downhole drill bit or a pressure of the drilling fluids and comparing the measured value to a reference value.

13. The method of claim 11, wherein determining the trigger condition being satisfied further comprises receiving a control signal from a controller, wherein the control signal is provided in response to a rotation protocol.

14. The method of claim 11, further comprising biasing the sleeve against the body to close the port from the nozzle upon determining the trigger condition has not been satisfied.

15. The method of claim 14, wherein biasing the sleeve against the body to close the port from the nozzle comprises offsetting the port from the nozzle using a spring.

16. The method of claim 11, wherein actuating the sleeve to move relative to the body comprises sliding the sleeve inside the body or rotating the sleeve inside the body or both.

17. The method of claim 11, further comprising regulating the portion of the flow of drilling fluids bypassed the drill bit using helical carved structures to facilitate fluid flow in the annulus.

18. The method of claim 11, wherein directing a portion of the flow of drilling fluids through the port and the nozzle to bypass the drill bit comprises actuating the sleeve to move relative to the body to align an opening in the sleeve to the nozzle of the body, wherein actuating the sleeve includes providing a high pressure oil flow, using a motor driven pump, to move the sleeve.

19. A device for bypassing drill fluids around a drill bit, the device comprising:

a sleeve sealingly slidable inside a body, the sleeve having a port alignable with a nozzle of the body;

a resilient member biasing the sleeve against the body, wherein the resilient member comprises a spring providing a biasing force corresponding to a threshold trigger pressure;

an actuator configured to provide a pressure to the sleeve and actuate the sleeve to move relative to the body; and a controller configured to operate the actuator to actuate the sleeve to move relative to the body in response to a change of a monitored operation condition;

wherein the controller is configured to monitor the change of a monitored operation condition by comparing a pressure of drilling fluids inside the drill string in an accumulator or pressure compensator, and a pressure of the drilling fluids in the annulus outside the drill string in another accumulator or pressure compensator to ascertain a pressure difference.

20. The device of claim 19, wherein the sleeve is configured to direct drill fluids to the drill bit when the port is not aligned with the nozzle of the body and is configured to direct a portion of the drill fluids to the drill bit when the port becomes at least partially aligned with the nozzle of the body such that another portion of the drill fluids bypasses the drill bit.

21. The device of claim 19, further comprising a lock ring setting a movement limit to the sleeve.

22. The device of claim 19, wherein the body comprises an internal tube housing the sleeve and at least one radial compartment housing at least one of an oil accumulator, a motor pump, a battery, the actuator, or the controller.

23. The device of claim 19, wherein the actuator includes a three-way control valve.

24. The device of claim 19, wherein the actuator includes an accumulator, a pressure compensator, or both.

25. The device of claim 19, wherein the controller is configured to operate the actuator to actuate the sleeve to move relative to the body in response to an internal drill string pressure variation measured in a pressure transducer, wherein the internal drill string pressure variation satisfies a trigger condition.

26. The device of claim 19, wherein the body comprises helical carved structures distributed radially on an external surface of the body.

27. The device of claim 26, wherein the helical carved structures are configured to facilitate flow of the drill fluids bypassed the drill bit.

28. A method for controlling drilling fluids in a drill string to bypass a drill bit, the method comprising:

providing the drill bit a flow of drilling fluids in the drill string, wherein the flow of drilling fluids returns in an annulus, wherein a resilient member comprises a spring providing a biasing force corresponding to a threshold trigger pressure;

determining whether a trigger condition has been satisfied;

upon determining the trigger condition has been satisfied, actuating a sleeve to move relative to a body sealingly housing the sleeve, and at least partially aligning a port in the sleeve to a nozzle of the body; and directing a portion of the flow of drilling fluids through the port and the nozzle to bypass the drill bit;

wherein determining the trigger condition being satisfied comprises comparing a pressure of the drilling fluids inside the drill string and a pressure of the drilling fluids in the annulus outside the drill string to ascertain a pressure difference, and wherein actuating the sleeve to move relative to the body comprises actuating a three-way valve in response to the pressure difference between the drilling fluids inside the drill string and the drilling fluids in the annulus, and wherein comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

29. The method of claim 28, wherein determining the trigger condition being satisfied further comprises measuring a value related to a rotation speed of the downhole drill bit or a pressure of the drilling fluids and comparing the measured value to a reference value.

30. The method of claim 28, wherein determining the trigger condition being satisfied further comprises receiving a control signal from a controller, wherein the control signal is provided in response to a rotation protocol.

31. The method of claim 28, further comprising biasing the sleeve against the body to close the port from the nozzle upon determining the trigger condition has not been satisfied.

32. The method of claim 31, wherein biasing the sleeve against the body to close the port from the nozzle comprises offsetting the port from the nozzle using a coil spring.

33. The method of claim 28, wherein actuating the sleeve to move relative to the body comprises sliding the sleeve inside the body or rotating the sleeve inside the body or both.

34. The method of claim 28, further comprising regulating the portion of the flow of drilling fluids bypassed the drill bit using helical carved structures to facilitate fluid flow in the annulus.

35. The method of claim 28, wherein directing a portion of the flow of drilling fluids through the port and the nozzle to bypass the drill bit comprises actuating the sleeve to move relative to a body to align an opening in the sleeve to the nozzle of the body, wherein actuating the sleeve includes providing a high pressure oil flow, using a motor driven pump, to move the sleeve.

* * * * *